US008495963B2

(12) United States Patent
Bernloehr et al.

(10) Patent No.: US 8,495,963 B2
(45) Date of Patent: Jul. 30, 2013

(54) SHALLOW WATER ANCHOR

(75) Inventors: Darrel A. Bernloehr, Mankato, MN (US); Gregory Paul Beamer, Mankato, MN (US); David M. Samek, Eagle Lake, MN (US)

(73) Assignee: Johnson Outdoors Inc., Racine, WI (US)

( * ) Notice: Subject to any disclaimer, the term of this patent is extended or adjusted under 35 U.S.C. 154(b) by 279 days.

(21) Appl. No.: 12/714,572

(22) Filed: Mar. 1, 2010

(65) Prior Publication Data

US 2011/0209652 A1 Sep. 1, 2011

(51) Int. Cl.
*B63B 22/02* (2006.01)

(52) U.S. Cl.
USPC ..... 114/230.13

(58) Field of Classification Search
USPC ..... 114/230.1, 230.13, 230.15, 230.16, 114/230.17, 230.18, 230.19, 293, 294, 295; 52/118; 312/333
See application file for complete search history.

(56) References Cited

U.S. PATENT DOCUMENTS

| | | | | |
|---|---|---|---|---|
| 2,536,908 | A | 1/1951 | Chadwick | |
| 2,907,294 | A | 10/1959 | Lawler | |
| 3,238,912 | A | 3/1966 | Perlick | |
| 3,693,569 | A | 9/1972 | Chauvin | |
| 4,070,978 | A | 1/1978 | Virgilio | |
| 4,254,730 | A * | 3/1981 | Crenshaw | 114/294 |
| 4,721,053 | A * | 1/1988 | Brewerton | 114/230.13 |
| 4,781,138 | A | 11/1988 | Hay | |
| 4,932,176 | A * | 6/1990 | Roberts et al. | 52/118 |
| 5,193,785 | A | 3/1993 | McVaugh | |
| 5,218,375 | A * | 6/1993 | Hillman | 343/883 |
| 6,041,730 | A | 3/2000 | Oliverio et al. | |
| 6,092,484 | A | 7/2000 | Babin et al. | |
| 6,220,197 | B1 | 4/2001 | Pohlman | |
| 6,273,016 | B1 | 8/2001 | Gibbs | |
| 6,895,884 | B1 | 5/2005 | Velázquez | |
| 6,938,967 | B2 * | 9/2005 | Dubon et al. | 312/333 |
| 7,111,574 | B2 * | 9/2006 | Slatter | 114/255 |
| 7,186,002 | B2 | 3/2007 | Matthews et al. | |
| 7,270,072 | B2 | 9/2007 | Waldrop | |
| 7,270,073 | B1 | 9/2007 | Waldrop et al. | |
| 7,827,927 | B2 * | 11/2010 | Kivi | 114/294 |
| 7,921,794 | B1 * | 4/2011 | Cullom et al. | 114/294 |
| 7,971,548 | B2 * | 7/2011 | Kuenzel | 114/294 |
| 2007/0151497 | A1 | 7/2007 | Gehrer | |
| 2009/0037040 | A1 | 2/2009 | Salmon et al. | |
| 2011/0107952 | A1 * | 5/2011 | Nicholson, IV | 114/230.13 |
| 2012/0046846 | A1 | 2/2012 | Dollens | |

OTHER PUBLICATIONS

Power-Pole, Shallow Water Anchor, pages printed from a website, date last visited May 27, 2010, 2 pages, http://www.power-pole.com/.
U.S. Appl. No. 12/714,578, filed Mar. 1, 2010, Bernloeher et al.
U.S. Appl. No. 12/714,588, filed Mar. 1, 2010, Bernloehr et al.
U.S. Appl. No. 13/292,147, filed Nov. 9, 2011, Bernloehr.

* cited by examiner

*Primary Examiner* — Lars A Olson
*Assistant Examiner* — Anthony Wiest
(74) *Attorney, Agent, or Firm* — Reinhart Boerner Van Deuren P.C.

(57) ABSTRACT

A shallow water anchor is provided. The shallow water anchor comprises a first anchor extension and a second anchor extension axially received by a housing. The first anchor extension is axially received by the second anchor extension such that the first and second anchor extensions are sequentially deployable from the housing an actuation arrangement. The actuation arrangement is controlled by a control interface that is operable to detect when the shallow water anchor has reached a fully extended state and fully retracted state. The shallow water anchor further includes a biasing compensator that compensates for fluctuations in the overall depth of water the anchor is deployed in due to waves or other anomalies.

16 Claims, 13 Drawing Sheets

SHALLOW WATER ANCHOR

FIELD OF THE INVENTION

This invention generally relates to anchors for watercraft and more particularly to anchors used in shallow water conditions.

BACKGROUND OF THE INVENTION

Commercial and recreational fishing is often conducted in shallow water. Both fresh water and salt water shallows are often populated with a variety of fish. Fishermen who fish these waters precisely locate and anchor their boat in areas where the amount of fish caught will be maximized. Often times fishermen will locate their boat where fish are visually detectable within the water through a technique called sight fishing. When using this technique, the fishermen must make every attempt to minimize noise so as not to scare the fish.

Conventional anchors are typically used to anchor a boat when shallow water fishing. A conventional anchor may take on various forms but generally has the form of a mass located at the end of a rope or chain that is in turn attached to the boat. To anchor the boat, a fisherman simply drops or throws the mass into the body of water letting it sink to a bottom thereof.

Unfortunately, several problems arise when using a conventional anchor during shallow water fishing. First, because the anchor is ordinarily tethered to the boat using a rope or chain, the boat will drift when anchored due to currents within the water. This drifting effect can place the boat in an unintended position other than a position most advantageous for shallow water fishing. Second, a loud noise and splash is produced when the anchor is thrown into the water that in turn can scare away the fish in proximity to the boat. Third, the mass often times drags across the bottom surface of the body of water and stirs up particulate matter such that the fisherman's view of fish within the water is obscured. Additionally, the mass can damage the vegetation growing at the bottom of the body of water as it drags across it.

In view of the above, it is desirable to have an anchor that anchors a watercraft within the water such that the watercraft does not drift due to current. It is further desirable that such an anchor function without producing an excessive amount of noise or obscuring the clarity of the water.

Embodiments of the invention provide such an anchor. These and other advantages of the invention, as well as additional inventive features, will be apparent from the description of the invention provided herein.

BRIEF SUMMARY OF THE INVENTION

In view of the above, embodiments of the invention provide a new and improved shallow water anchor that overcomes one or more of the problems existing in the art. More specifically, embodiments of the present invention provide a new and improved automated and sequentially deploying shallow water anchor. Embodiments of the shallow water anchor further provide a compact shallow water anchor that can be rapidly deployed in a generally quiet manner so as not to scare away any fish in proximity to a boat incorporating the shallow water anchor. These embodiments can incorporate a controller to ensure that the anchor has fully seated in a position sufficient to anchor the boat.

In a one embodiment, a sequentially extending shallow water anchor is provided. The anchor includes a first anchor extension and a second anchor extension attached to the first anchor extension. A base member is attached to the second anchor extension. The anchor further includes an actuation arrangement. The actuation arrangement is operable to sequentially axially drive the first and second anchor extensions in a deployment direction, wherein the second anchor extension remains in a substantially constant position relative to the base section. The second anchor extension remains in the substantially constant position relative to the base section until the first anchor extension has transitioned to a fully deployed position relative to the second anchor extension in the deployment direction.

In another embodiment, the first anchor extension includes an anchoring portion and a stopping portion. The second anchor extension includes a deployment catch portion. The stopping portion of the first anchor extension axially abuts the deployment catch portion of the second anchor extension in the fully deployed position. Thereafter, the first and second anchor extensions deploy relative to the base section in unison. In certain embodiments, the stopping portion is formed by a piston at an end of the anchoring portion, and the deployment catch portion is carried by the second anchor extension. The anchoring portion extends through the deployment catch portion in the fully deployed position, and the piston axially abuts the deployment catch portion in the fully deployed position. In certain embodiments, a retraction catch is also provided that is affixed to the second anchor extension. The first anchor extension has a fully retracted position relative to the second anchor extension. The stopping portion is in axially abutted contact with the retraction catch in the fully retracted position. The stopping portion is axially interposed between the retraction catch and the deployment catch.

In another embodiment, the shallow water anchor further includes at least one guide arrangement interposed between the second anchor extension and the housing. The at least one guide arrangement is operable to guide the second anchor extension in a deployment direction relative to the housing and axially therefrom. In certain embodiments, the at least one guide arrangement includes an inner slide channel associated with the second anchor extension and aligned with an outer slide channel associated with the base member. The at least one guide arrangement further includes a first stop affixed to the base member and slidable within the inner slide channel, and a second stop affixed to the second anchor extension and slidable with the outer slide channel. The first and second stops engage in an abutted contact when the second anchor extension is fully deployed along the deployment direction relative to the base member.

In another embodiment, at least one of the first and second stops is biased away from the base member or the second anchor extension, respectively, and into frictional contact with the other one of the second anchor extension or the base member, respectively. This frictional contact is sufficient to prevent translation of the second anchor extension relative to the base member as the first anchor extension is deployed relative to the second anchor extension. In certain embodiments, the frictional contact is sufficient to prevent the second anchor extension from translating relative to the base member as the first anchor extension is retracted relative to the second anchor extension in the retraction direction opposite the deployment direction, at least until the first anchor extension is in the fully retracted position relative to the second anchor extension.

In another embodiment, a compact, linearly extending shallow water anchor is provided. The shallow water anchor according to this embodiment includes a first anchor extension and a second anchor extension. A base section carries the first and second anchor extensions. A first cable is operably connected to the first anchor extension. A second cable is also operably connected to the first anchor extension. The first and second cables are windable and un-windable about a spool. A motor is operably connected to the spool to wind and unwind the first and second cables about the spool to selectively deploy and retract the first and second anchor extensions from the housing.

In another embodiment, the motor operably rotates the spool in a first direction to simultaneously wind the first cable and unwind the second cable about the spool. The motor also operably rotates the spool in a second direction to simultaneously wind the second cable and unwind the first cable about the spool. Rotation in the first direction deploys the first anchor extension relative to the second anchor extension. Rotation in the second direction retracts the first anchor extension relative to the second anchor extension. In certain embodiments, the anchor further includes a first, a second, and a third pulley. The first and second pulleys are affixed to the second anchor extension, and the third pulley is affixed to the base member. The first and second pulleys are movable relative to the base member with the second anchor extension. Also in certain embodiments, the anchor includes a slip clutch disposed between the motor and the spool. The slip clutch is operable to transfer a torque from the motor to the spool. The slip clutch disengages the spool from the motor to allow the spool to rotate in the second direction independently of and relative to the motor when a predetermined load threshold of the anchor is reached.

In another embodiment, the first and second cables are arranged in an opposed relationship relative to the first anchor extension such that a tensile force in the first cable retracts the first anchor extension and a tensile force in the second cable deploys the first anchor extension. The first cable is windable and unwindable about a first half of the spool, and the second cable is windable and unwindable about a second half of the spool.

In another embodiment, the anchor further includes a control interface that controls the motor to axially deploy the first and second anchor extensions relative to the base member. The control interface detects when the anchor has reached a deployed position sufficient to anchor a watercraft in an anchored position, and stops the motor once the anchor reaches the deployed position. The control interface controls the motor to retract the first and second anchor extensions relative to the base member. The control interface also detects when the anchor has reached a fully retracted position and stops the motor once the anchor reaches the retracted position. In certain embodiments, the control interface includes a visual indicator indicating a length of anchor deployed.

In another embodiment, a shallow water anchor that compensates for waves or other fluctuations is provided. The anchor includes a first and a second anchor extension and a base section carrying the first and second anchor extensions. An actuation arrangement is operable to deploy and retract the first anchor extension relative to the second extension and deploy and retract the second anchor extension relative to the base section. A biasing compensator is operably connected to at least one of the first anchor extension, second anchor extension, and actuation arrangement. The biasing compensator is operable to return the at least one of the first anchor extension, second anchor extension, and actuation arrangement to a first orientation upon a displacement to a second orientation.

In another embodiment, the biasing compensator is a torsion spring. The actuation arrangement includes a spool operably coupled to the first anchor extension to deploy and retract the first anchor extension upon coordinated rotation thereof. The torsion spring is torsionally connected to the spool to oppose retraction of the first anchor extension when an external load is applied to the anchor causing the first anchor extension to retract. The first orientation defines an angular position of the spool when the anchor is in a deployed position, and a second angular position being a different angular position relating to a retracted position relative to the deployed position. In certain embodiments, the first anchor extension is operably connected to the actuation arrangement such that the displacement is a partial linear retraction of the first anchor extension axially relative to the second anchor extension.

In another embodiment, a method for anchoring a watercraft using a sequentially extending shallow water anchor is provided. The method according to this embodiment includes linearly deploying a first anchor extension relative to a second anchor extension carrying the first anchor extension. The method according to this embodiment further includes linearly deploying the second anchor extension relative to a base member carrying the second anchor extension after the first anchor extension has fully deployed relative to the second anchor extension. In certain embodiments, the method further includes stopping the deployment of the first anchor extension relative to the second anchor extension such that deployment of the second anchor extension relative to the base member equally translates the first anchor extension relative to the base member.

In another embodiment, the step of stopping may include engaging a first catch of the first anchor extension with a second catch of the second anchor extension when the first anchor extension is fully deployed relative to the second anchor extension such that the first and second anchor extensions translate in unison in a deployment direction. The step of stopping does not stop the deployment of the first anchor extension relative to the base member. In certain embodiments, engaging the first catch with the second catch includes only axially abutting the first catch with the second catch.

In another embodiment, the method further includes stopping the deployment of the second anchor extension relative to the housing a first stop of the base member and a second stop of the second anchor extension. The first and second stops maintain an abutted axial contact when the second anchor extension is fully deployed relative to the base member. In certain embodiments, the method can also include the step of maintaining the position of the second anchor extension relative to the base member until the first anchor extension is fully deployed during the step of deploying the first anchor extension. Also in certain embodiments, the method can include the step of retracting the first anchor extension relative to the second anchor extension, and the step of maintaining the position of the second anchor extension relative to the base member until the first anchor extension has been fully retracted relative to the second anchor extension.

In another embodiment, the method further includes the step of unwinding a first cable affixed to the first anchor extension from a spool and winding a second cable affixed to the first anchor extension from the spool when deploying the first anchor extension. In certain embodiments, the method further includes deploying the second anchor extension, with the second cable transferring a first load to the first anchor extension to deploy the first anchor extension relative to the second anchor extension. The first cable transfers a second load to the first anchor extension to retract the first anchor extension relative to the second anchor extension.

In another embodiment, a method for automatically deploying an anchor from a watercraft is provided. The method includes the steps of deploying a first anchor extension and detecting when the first anchor extension has engaged an object in the body of water. The method further includes stopping the deploying of the first anchor extension after the step of detecting.

In another embodiment, the step of detecting includes sensing a sensed current load on a motor of the actuation arrangement and further includes the step of comparing the sensed current load with a benchmark current load. The step of detecting further including determining that the first anchor extension has engaged an object when the sensed current load is at least the benchmark current load. In certain embodiments, the method includes the step of waiting a first period of time after the steps of deploying, detecting, and stopping until each of the steps of deploying, detecting, and stopping have occurred a first predetermined number of times. The method can also include the step of waiting a second period of time being greater than the first period of time after the steps of deploying, detecting, and stopping have occurred the first predetermined number of times and then repeating, a second predetermined number of times, the steps of repeatedly performing the steps of deploying, detecting, and stopping the first predetermined number of times.

In another embodiment, the method includes retracting the at least one anchor extension and detecting when the at least one anchor extension has been fully retracted relative to a base member of the anchor. The method further includes stopping the retraction of the at least one anchor extension after the step of detecting when the at least one anchor extension has been fully retracted. In certain embodiments, the step of detecting when the at least one anchor extension has been fully retracted comprises sensing the location of the at least one anchor extension relative to the base member.

In another embodiment, a method for operating an anchor in an automated process is provided. The method according to this embodiment includes deploying at least one anchor extension in a first direction and then retracting the at least one anchor extension in a second direction opposite the first direction. After the at least one anchor extension has retracted, the method further includes deploying again the at least one anchor extension in the first direction. The method can further include the step of retracting again, then repeating at least once the steps of deploying, retracting, and deploying again, wherein the steps of deploying, retracting, deploying again, retracting again, and repeating at least once define a pack cycle. The method can also further include the step of determining the occurrence of the first, second, and third conditions. The step of deploying includes deploying the at least one anchor extension until a first condition is met, the step of retracting includes retracting the at least one anchor extension until a second condition is met, and the step of deploying again includes deploying again the at least one anchor extension until a third condition is met.

In another embodiment, the first and third conditions are a current limit reached by a motor operably connected to the at least one anchor extension to drive deployment and retraction of the at least one anchor extension, and the second condition is a number of motor revolutions of the motor. In certain embodiments, the steps of deploying, retracting, and deploying again occur without interruption from a user. In certain other embodiments, the first, second, and third conditions occur without interruption from a user. The current limit is detected by a first sensor in electronic communication with a controller. The number of motor revolutions are detected by a second sensor in electronic communication with the control interface.

In another embodiment, an anchoring system that allows for control of more than one anchor remotely is provided. The anchoring system according to this embodiment includes a first anchor having a first receiver and a first remote control including a transmitter arrangement operable to send at least one control signal directly to the first receiver of the first anchor and to a second receiver of a second anchor independently of the first anchor. The first remote control can directly control the first anchor and the second anchor. In certain embodiments, the first remote control is operable to control the first anchor and the second anchor simultaneously. The first remote control transmitter arrangement is operable to send at least a first and a second control signal. The remote control further including an anchor selector switch, the anchor selector switch operable to configure the transmitter arrangement to send at least one of the first and second control signals.

In another embodiment, the second anchor includes the second receiver, the remote control sends the first and second signals directly to the first and second receivers such that the first and second signals do not have interaction with the other ones of the first and second anchors. The first and second signals are transmitted to the first and second anchors, respectively.

In another embodiment, the first anchor, second anchor and remote control are configured such that the first anchor alters operation only in response to the first control signal and not the second control signal and the second anchor only alters operation in response to the second control signal and not the first control signal.

In another embodiment, the anchor selector switch includes a first condition wherein the transmitter arrangement is configured to operably send only the first control signal, a second condition wherein the transmitter arrangement is configured to operably send only the second control signal, and a third condition wherein the transmitter arrangement is configured to operably send both the first and second control signals.

In another embodiment, a method for operating an anchoring system is provided. The method according to this embodiment includes sending a control signal directly to a first anchor to initiate an alteration in the operation of the first anchor from a remote control. The method further includes sending a control signal directly to a second anchor to initiate an alteration in the operation of the second anchor from the remote control such that the remote control is operable to control each of the first and second anchors. In certain embodiments, the method includes the steps of sending a control signal directly to a first anchor to initiate an alteration in the operation of the first anchor from a remote control and sending a control signal directly to a second anchor to initiate an alteration in the operation of the second anchor from the remote control include sending a same control signal to both the first and second anchors from the remote control. In certain other embodiments, the method can also include a step of selecting, with the remote control, both of the first and second anchors to be controlled by the first remote control, and then sending the same control signal to both the first and second anchors from the remote control simultaneously, and in other embodiments sending the first control signal when the first anchor is selected and sending the second control signal when the second anchor is selected.

In another embodiment, an anchor that provides a user with a visual indication of a depth of extension or refracted is provided. The anchor according to this embodiment includes a base section and at least one anchor extension carried by the base section. The at least one anchor extension is deployable and retractable relative to the base section. The anchor further includes a visual indicator, the visual indicator operable to display a visual indication corresponding to an amount of deployment of the at least one anchor extension relative to the base section. In certain embodiments, the base section is a housing axially receiving the at least one anchor extension. The visual indicator is mounted to the housing and the housing remains fixed relative to the at least one anchor extension during a deployment and a retraction of the at least one anchor extension from the base section.

In another embodiment, the anchor further includes a control interface, a sensor and an actuation arrangement. The actuation arrangement is operable to axially deploy and retract the at least one anchor extension from the housing. The sensor is operably connected to the control interface to provide a signal corresponding to the amount of deployment. The control interface is operable to correlate the signal with the amount of deployment. A portion of the sensor is mounted upon the actuation arrangement. The actuation arrangement can include a motor and a clutch. The portion of the sensor can be mounted to the clutch, with the sensor operable to sense rotations of the clutch as the actuation arrangement operably deploys and retracts the at least one anchor extension. The rotations of the clutch correspond to the amount of deployment of the at least one anchor extension.

In another embodiment, the visual indicator is a plurality of LED lights. The plurality of LED lights are operably connected to the control interface of the anchor. The control interface is operable to supply power to illuminate select ones of the plurality of LED lights. The select ones of the plurality of LED lights correspond to the amount of deployment of the at least one anchor extension.

In another embodiment, an anchor for a watercraft that presents a high level of adjustability is provided. An anchor according to this embodiment includes a base section and at least one anchor extension carried by the base section, a mounting bracket, and a connection arrangement between the mounting bracket and the base section. The connection arrangement provides both linear and angular adjustment of the base section relative to the mounting bracket. In certain embodiments, the connection arrangement includes at least one mounting bar. The at least one mounting bar is received by at least one channel. The at least one channel is formed into the base section. The mounting bar is selectively linearly slidable within the at least one channel. The at least one mounting bar is slidable within the at least one channel to provide linear adjustment of the base section relative to the mounting bracket. The at least one mounting bar is operable to fix the base section relative to the mounting bracket by a frictional contact therebetween. The at least one mounting bar also defines a first mounting point and a second mounting point of the base section relative to the mounting bracket. The first and second mounting points are selectively adjustable relative to the mounting bracket to provide the angular adjustment of the base section.

In another embodiment, the mounting bracket has single mounting hole and an arcuate array of mounting holes independent from the single mounting hole, the single mounting hole corresponding to the first mounting point and a select one of the arcuate array of mounting holes corresponding to the second mounting point. The mounting bracket provides positive and negative angular adjustment of the base section relative to the mounting bracket.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
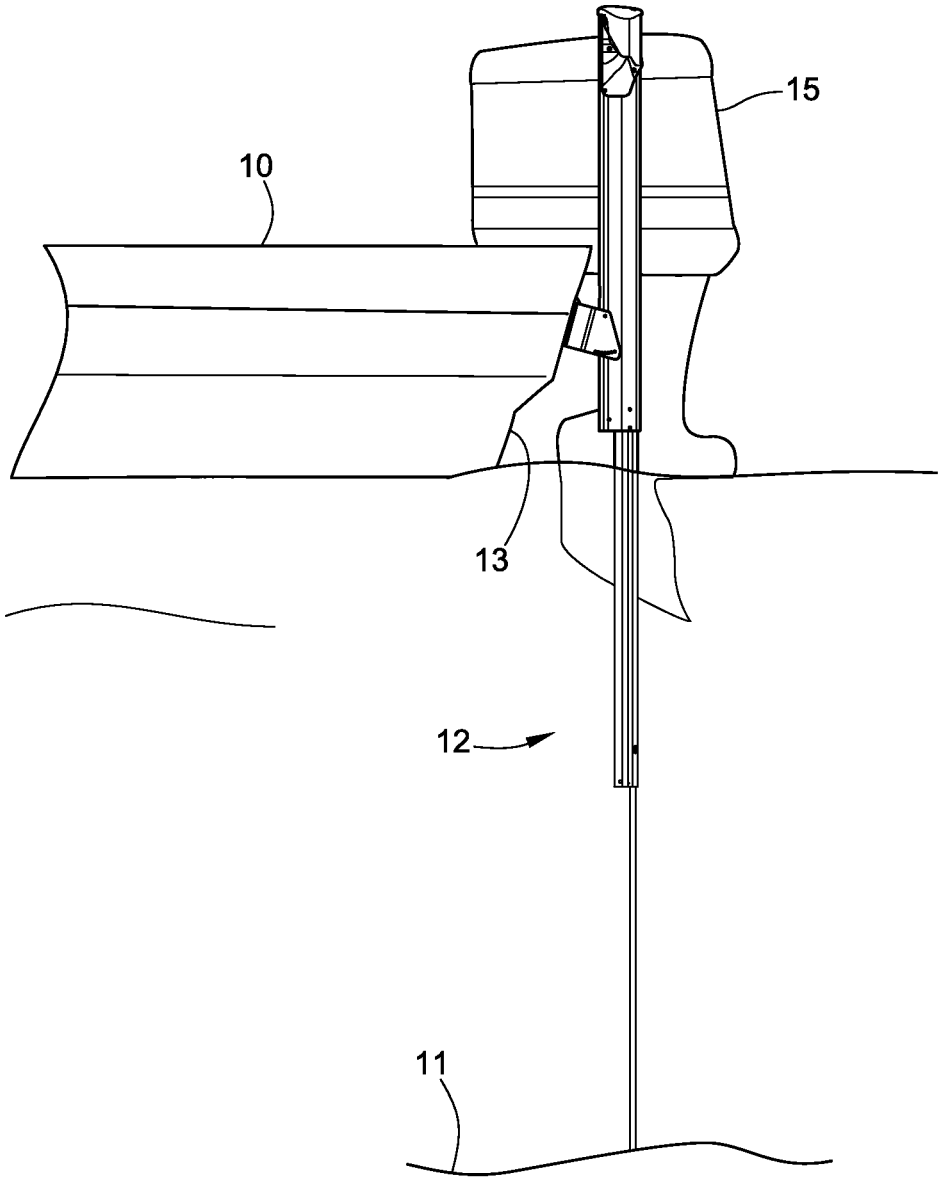
FIG. 1 is a side view of an exemplary embodiment of a shallow water anchor affixed to a watercraft.

Turning now to the drawings, an embodiment of a shallow water anchor 12 is illustrated mounted to a transom 13 of a boat 10 in FIG. 1. As illustrated, the shallow water anchor 12 is proximate to an outboard motor 15 of the boat 10. A passenger of the boat 10 can control the shallow water anchor 12 while seated anywhere within the boat 10. Although illustrated as mounted to the transom 13 of the boat 10, the shallow water anchor 12 may be mounted to other locations of the boat 10, and is not limited to the transom 13 only. It will be recognized that while the following description will utilize such an exemplary environment in describing the various features and functionality of the present invention, such description should be taken by way of example and not by way of limitation.

As will be discussed in greater detail below, the shallow water anchor 12 is selectively positionable between a deployed position and a retracted position in a deployment direction and a retraction direction respectively. The terms "deploy", "deploying", "retract" and "retracting" do not require the shallow water anchor to completely deploy or retract to the deployed or retracted positions respectively.

Instead, "deploy", "deploying", "retract", and "retracting" as used herein indicate incremental operation of the shallow water anchor, but do not necessarily require a full deployment or a full retraction.

Turning now to FIG. 1, when in the retracted position, the shallow water anchor 12 retains a generally smooth and compact appearance, and generally remains above the bottom of the hull line and may dip below the water line when the boat is at rest. When in the extended position, as illustrated in FIG. 1, the shallow water anchor 12 passes through the water and makes contact with a bottom surface 11 of a river, lake, or similar body of water. Once extended, the shallow water anchor 12 anchors the boat 10 in a generally fixed location within the body of water. As will be discussed in greater detail below, an actuation arrangement 68 (see FIGS. 6 and 7) is operable to sequentially extend a first anchor extension 24 and a second anchor extension 36 from a base member in the form of a housing 14 of the shallow water anchor 12.

Figure 2:
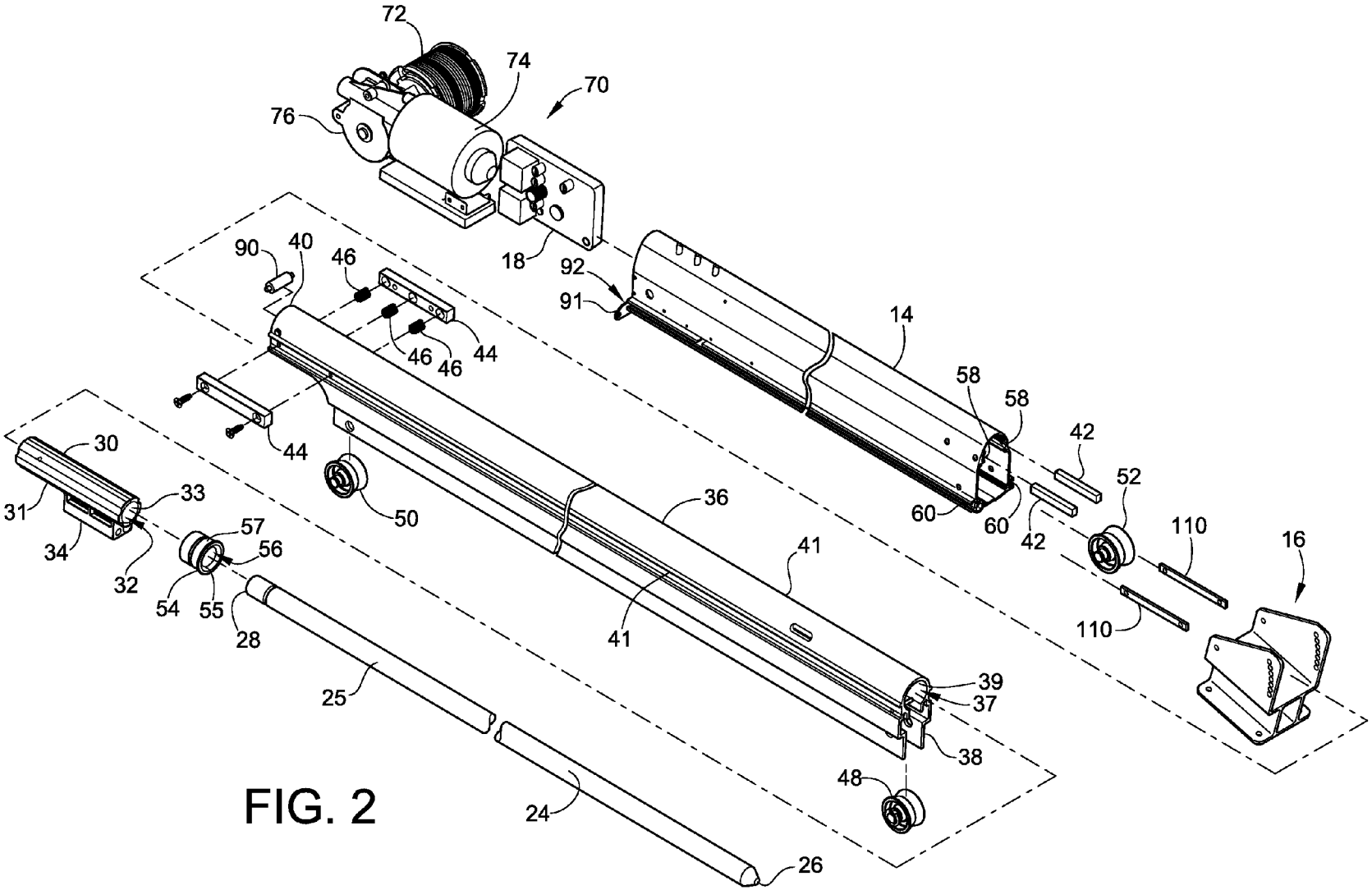
FIG. 2 is a partial exploded perspective view of the shallow water anchor of FIG. 1.

With reference now to FIG. 2, an embodiment of the shallow water anchor 12 includes a first anchor extension 24, and a second anchor extension 36. The first anchor extension 24 is axially received by the second anchor extension 36, and the second anchor extension 36 is axially received by the housing 14. An actuation arrangement 68 (see FIGS. 6 and 7) is operable to sequentially extend and retract the first and second anchor extensions 24, 36 from and into the housing 14, respectively. By sequentially extend, it is meant that in certain embodiments the first anchor extension 24 extends to a fully extended position relative to the housing 14 before the second anchor extension 36 moves relative to the housing.

The base section, in the form of the housing 14, receives and protects the first and second anchor extensions 24, 36. However, in other embodiments, the base section is not so limited. Indeed, the base section can take the form of any structure sufficient to support at least one of the first and second anchor extensions 24, 36. For example, in other embodiments, the base section can take the form of a rail that at least one of the first and second anchor extensions 24, 36 glides upon. Additionally, the shallow water anchor 12 can include at least one anchor extension as opposed to a first and a second anchor extension 24, 36. Indeed, in certain embodiments, the shallow water anchor 12 can incorporate a single anchor extension and still provide the advantages of anchoring functionality as described herein.

Once the first anchor extension 24 is fully extended from the housing 14, the second anchor extension 36, if necessary, then extends from the housing 14 to increase the overall length of the shallow water anchor 12. The first anchor extension 24 is slidably retained within the second anchor extension 36 by way of a piston 30. The second anchor extension 36 is slidably retained within the housing 14 by way of a guide arrangement 64 (see FIG. 3). By utilizing sequential deployment when extending the first anchor extension 24 and the second anchor extension 36 from the housing 14, the exposure of the second anchor extension 36 to the elements is reduced. More particularly, at certain shallow depths of water, it will only be necessary to extend the first anchor extension 24 from the housing 14. At those shallow depths of water, the second anchor extension 36 remains within the housing 14 and thus is not subjected to the elements.

The first anchor extension 24 has a generally elongated rod-like appearance and generally functions as a spike. The first anchor extension 24 is structurally rigid enough to maintain a fully loaded boat 10 (see FIG. 1) including passengers and gear in an anchored position under transverse loading applied by the currents within the body of water. The first anchor extension 24 extends between first and second ends 26, 28. The first anchor extension has a generally cylindrical profile with an outer diameter 25. The first end 26 of the first anchor extension 24 has a generally conical shape. Although illustrated as having a generally conical first end 26, the first anchor extension 24 can employ other end geometry, e.g. a flat end or rounded end, as well as other end effects such as grating or knurling, and is not limited to a single point. Additionally, the first end 26 can also be provided as a replaceable tip or secondary attachment. As will be discussed in greater detail below, the second end 28 of the first anchor extension 24 is received by the piston 30.

Still referring to FIG. 2, the piston 30 has a generally sleeve-like appearance. During operation of the shallow water anchor 12, the piston 30 remains fixedly attached to the first anchor extension 24 and guides the first anchor extension 24 as the first anchor extension 24 is extended out of the second anchor extension 36. The piston 30 has an opening 32 with an inner diameter 33. The inner diameter 33 of the piston 30 is generally the same as the outer diameter 25 of the first anchor extension 24 so that there is minimal play between the first anchor extension 24 and the piston 30. The piston 30 also has a generally cylindrical profile with an outer diameter 31 substantially similar in size to an inner diameter 39 of an opening 37 of the second anchor extension 36. However, other profiles are contemplated, i.e. oval, rectangular, etc.

A cable retaining clamp 34 is affixed to or formed in the piston 30. The cable retaining clamp 34 functions to retain a first and second cables 100, 102 of the actuation arrangement 68 (see FIGS. 6 and 7). As a result, the first anchor extension 24 maintains mechanical communication with the actuation arrangement 68 via the piston 30.

The first anchor extension 24 has a stopping portion and an anchoring portion. The stopping portion includes the piston 30 and the length of the first anchor extension 24 received by the piston 30. The anchoring portion includes a portion of the first anchor extension 24 axially exposed from the piston 30 when the piston 30 is fully affixed to the first anchor extension 24. Although illustrated as separate components, the piston 30 and first anchor extension 24 can be a one-piece construction, i.e. formed by molding, machining, etc. such that the piston 30 and first anchor extension 24 are formed from a continuous material and not otherwise mechanically joined by welding or a similar process.

The second anchor extension 36 axially receives the first anchor extension 24 and functions to increase the combined length of the first and second anchor extensions 24, 36 of the shallow water anchor 12 when in the extended position. The second anchor extension 36 is axially received by the housing 14. The second anchor extension 36 deploys from the housing 14 after the first anchor extension 24 has fully extended from the second anchor extension 36 and the housing 14.

The second anchor extension 36 extends between first and second ends 38, 40. The second anchor extension 36 also includes an opening 37 having an inner diameter 39. The inner diameter 39 of the second anchor extension 36 is dimensioned to receive the piston 30 such that there is minimal to no radial play between the piston 30 and the second anchor extension 36. In one embodiment, the second anchor extension 36 also includes inner slides 41 formed on opposing sides of the second anchor extension 36.

A deployment catch portion is formed by a collar 54 axially received by, and affixed to, the second anchor extension 36 at the first end 38 thereof. The collar 54 has an opening 56 with an inner diameter 55. The inner diameter 55 is generally the same dimension, or a slightly larger dimension, as the outer diameter 25 of the first anchor extension 24. As a result, the anchoring portion of the first anchor extension 24 is allowed to pass axially through the collar 54. However, and as will be discussed in greater detail below, the piston 30 is too large to pass through the collar 54, such that the piston 30 abuts the collar 54 when the first anchor extension 24 is fully deployed relative to the second anchor extension 36. The collar 54 has a generally cylindrical outer periphery with an outer diameter 57. The outer diameter 57 of the collar 54 is generally the same as the inner diameter 39 of the opening 37 of the second anchor extension 36.

The shallow water anchor 12, and particularly the actuation arrangement 68 (see FIGS. 6 and 7) has a first pulley 48 and second pulley 50 carried by the second anchor extension 36, and a third pulley 52 carried by the housing 14. The first and second pulleys 48, 50 remain fixed relative to the second anchor extension 36 and linearly translate therewith when the second anchor extension 36 extends from the housing 14. As will be discussed in greater detail below, the pulleys 48, 50, 52 route the second cable 102 to the piston 30.

The shallow water anchor 12, and particularly the guide assembly 64 (see FIG. 3), has a pair of first stops 42 and a pair of second stops 44. The first and second stops 42, 44 are received by a pair of inner slides 41 of the second anchor extension 36 and a pair of outer slides 58 of the housing 14. Each one of the outer slides 58 fixedly receives one of the pair of first stops 42 such that the first stops 42 remain fixed with respect to the housing 14. The first stops 42 are slidable relative to the second anchor extension 36, and particularly within the inner slides 41. Each one of the inner slides 41 fixedly receives one of the pair of second stops 44. The second stops 44 are slidable relative to the housing 14 within the outer slides 58.

One of the second stops 44 includes a plurality of springs 46 which bias the second stop 44 away from the second anchor extension 36 and against the outer slide member 58 of the housing 14. As a result, a frictional force is exerted upon the housing 14 by way of the springs 46 biasing the second stop 44 thereagainst. This frictional force is sufficient to maintain the second anchor extension 36 within the housing 14 while the first anchor extension 24 is being deployed and until the first anchor extension 24 is fully deployed relative to the second anchor extension 36, and the second anchor extension 36 is axially extended from the housing 14 by way of the actuation arrangement 68 (see FIG. 7). Although illustrated as only incorporating springs 46 in one of the pair of second stops 44, in other embodiments both the second stops 44 can be spring loaded with springs 46. Additionally, in other embodiments, the first stops 42 can be spring loaded similar to that of the second stop 44.

Figure 3:
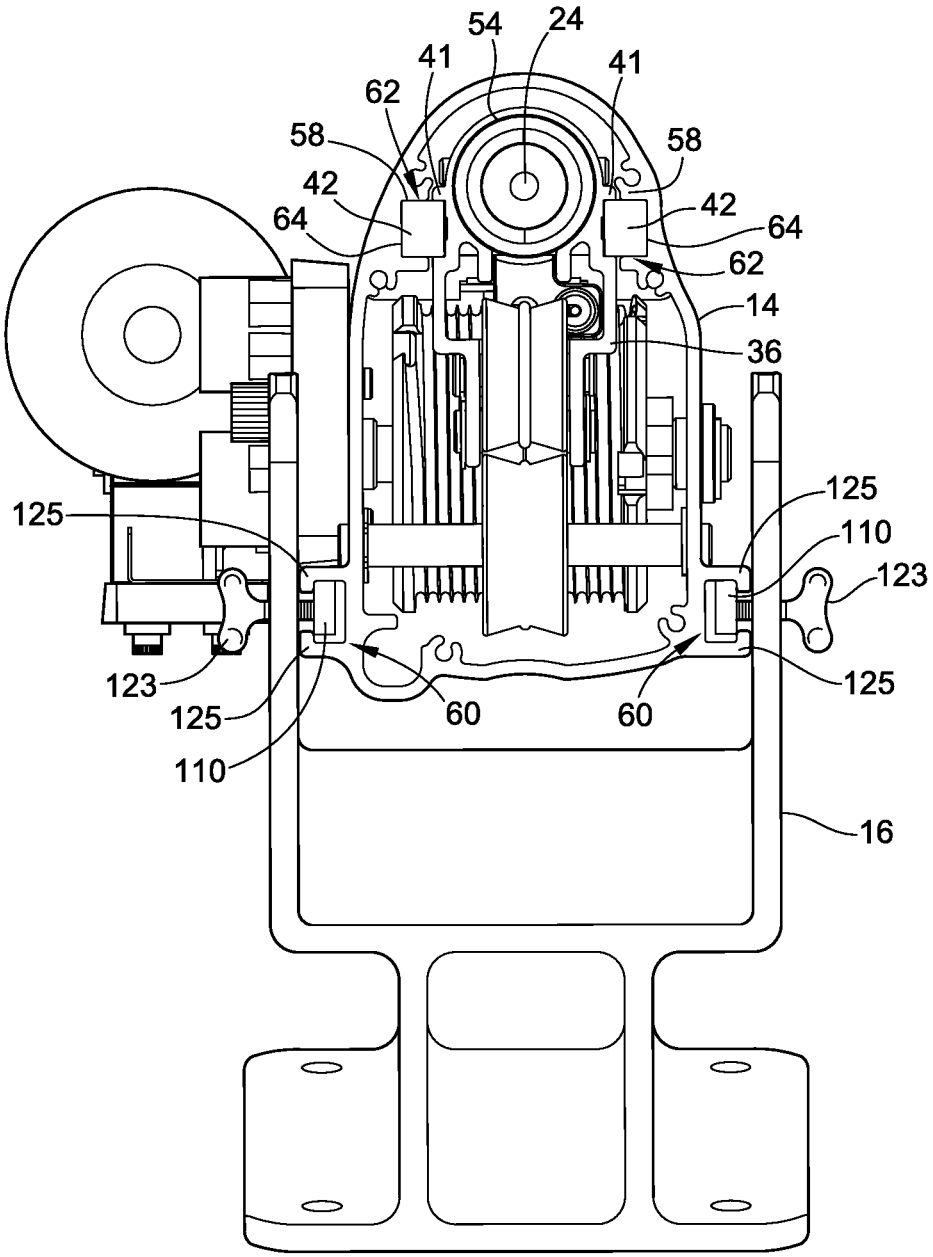
FIG. 3 is a bottom view of the shallow water anchor of FIG. 1 in a retracted position.

Now referring to FIG. 3, the inner slides 41 have a generally U-shaped cross section. The inner slides 41 are dimensioned to slidably receive a portion of a first stop 42 and fixedly receive a portion of a second stop 44 (see FIG. 2). The inner slides 41 correspond to the outer slides 58 formed on an interior surface of the housing 14. Similar to the inner slides 41, the outer slides 58 also receive a portion of the first stops 42 and a portion of the second stops 44 (see FIG. 2).

The inner slides 41 of the second anchor extension 36 and the outer slides 58 of the housing 14 together cooperatively form a channel 62. The inner slides 41, outer slides 58, the channel 62 formed therebetween, and the first stops and second stops 42, 44 together form a guide assembly 64. The guide assembly 64 facilitates linear translation of the second anchor extension 36 relative to the housing 14, while also preventing the second anchor extension 36 from fully extending out of the housing 14.

Figure 4:
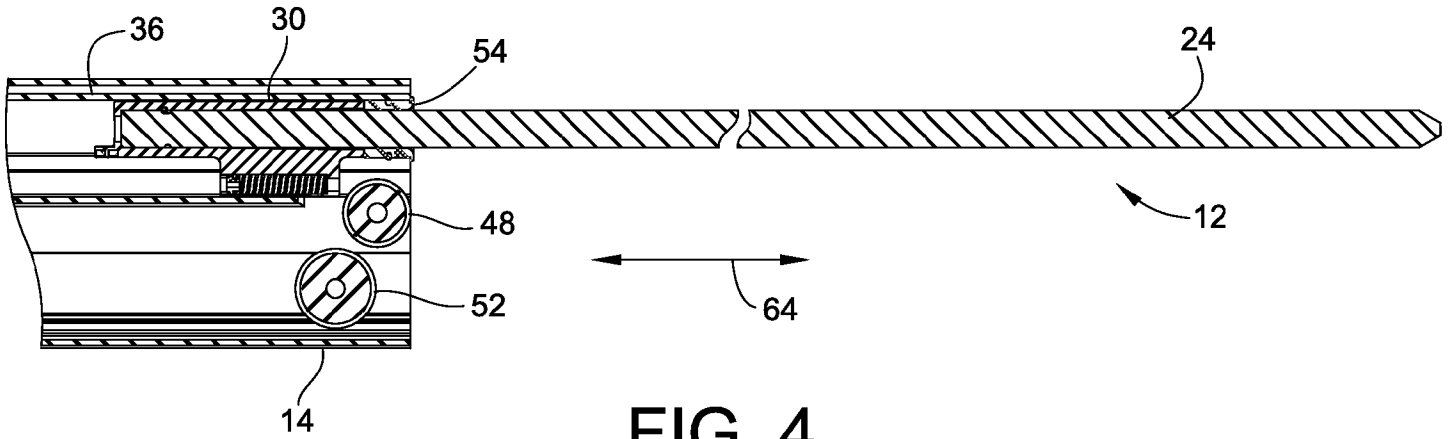
FIG. 4 is a partial side cross sectional view of the shallow water anchor of FIG. 1.

With reference to FIG. 4, the shallow water anchor 12 is shown in a partially extended position. When the actuation arrangement 68 (see FIGS. 6 and 7) axially extends the first anchor extension 24 from the housing 14 relative to the second anchor extension 36, the first anchor extension 24 travels along a deployment direction 64 relative to the second anchor extension 36 and the housing 14. The second anchor extension 36 remains disposed within the housing 14 until the piston 30 comes into axially abutted contact with the collar 54. When the piston 30 and collar 54 are in abutted contact, the first anchor extension 24 is at its full extension relative to the second anchor extension 36. Once the first anchor extension 24 is at full extension relative to the second anchor extension 36, the second anchor extension then begins to axially extend from the housing 14.

Figure 5:
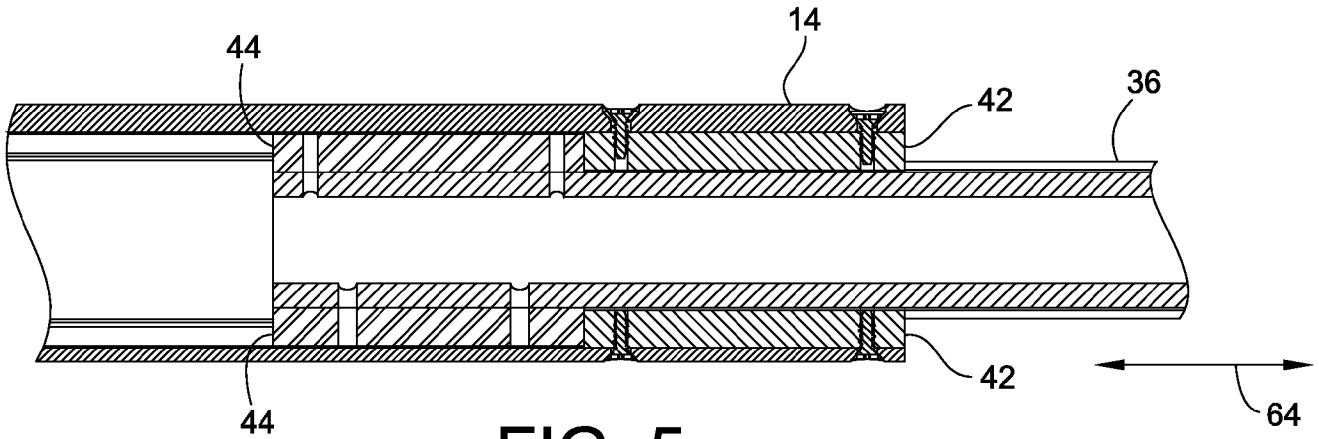
FIG. 5 is a partial side cross sectional view of the shallow water anchor of FIG. 1 in a fully extended position.

Turning to FIG. 5, once the first anchor extension 24 is fully extended from the second anchor extension 36, both the first and second anchor extensions 24, 36 then axially translate simultaneously along a deployment direction 64 relative to the housing 14. However, the first anchor extension 24 does not extend relative to the second anchor extension 36 during this stage of extension. The second anchor extension 36 continues to extend from the housing 14 until the second stops 44 come into abutted contact with the first stops 42. When this is so, and as will be discussed in greater detail below, a control interface 18 is operable to terminate further operation of the actuation arrangement 68. As a result, when the shallow water anchor 12 is at its full extended position, the control interface 18 terminates further attempts by the actuation arrangement 68 to extend the first anchor extension 24 or the second anchor extension 36 from the housing 14.

Figure 6:
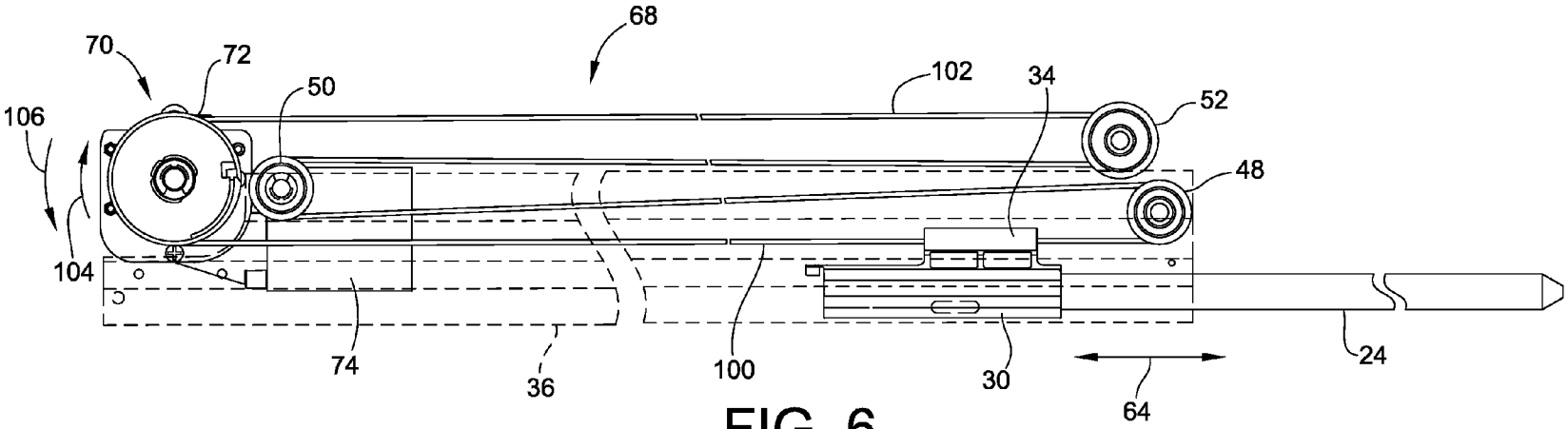
FIG. 6 is an exposed view of the actuation arrangement of the shallow water anchor of FIG. 1 with the housing removed and a second anchor extension shown in dashed lines for clarity.

Turning now to FIG. 6, one embodiment of the actuation arrangement includes a drive assembly 70, a plurality of pulleys 48, 50, 52 and a first and a second cable 100, 102. One end of each of the first and second cables 100, 102 remains fixed to a spool 72 of the drive assembly, while another end of each of the first and second cables 100, 102 is fixedly connected to the piston 30 at the cable retaining clamp 34. As will be discussed in greater detail below, the second cable 102 is routed through the plurality of pulleys 48, 50, 52 while the first cable 100 is free of contact with any of the pulleys 48, 50, 52.

When the spool 72 rotates in a first direction 104, the first cable 100 is wound about the spool 72 and the second cable 102 is unwound from the spool 72. Likewise, when the spool 72 rotates in a second direction 106 opposite the first direction 104, the first cable 100 is unwound from the spool 72 while the second cable 102 is simultaneously wound about the spool 72. As the first anchor extension 24 extends from the second anchor extension 36, the first cable 100 is unwound from the spool 72 and the second cable 102 is wound about the spool 72. The first and second pulleys 48, 50 remain in a substantially fixed position relative to the housing 14 until the first anchor extension 24 has fully extended from the second anchor extension 36, e.g. until the piston 30 comes into abutted contact with the collar 54 (not shown) as discussed above.

Figure 7:
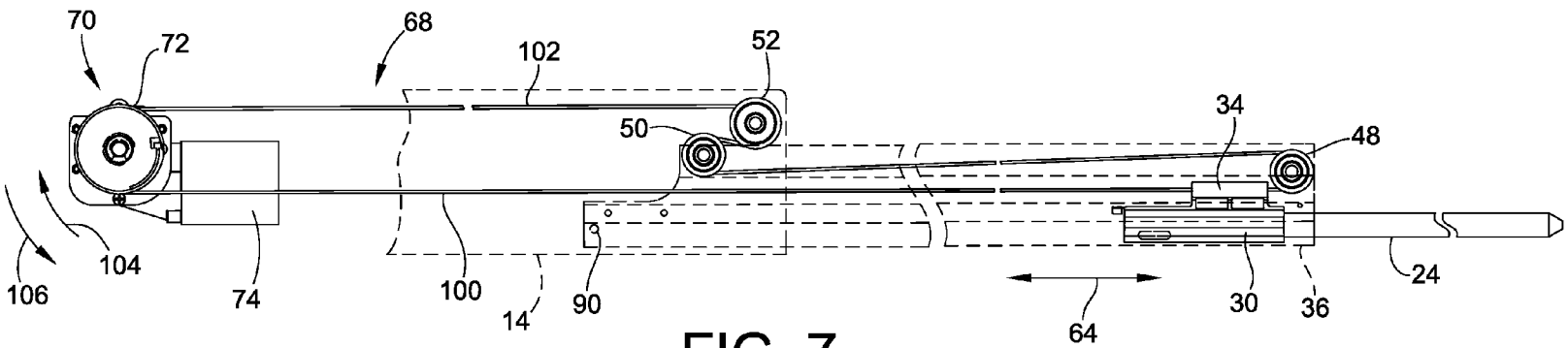
FIG. 7 is an exposed view of the actuation arrangement of FIG. 6 of the shallow water anchor of FIG. 1 in an alternate position with the housing removed and the second anchor extension shown in dashed lines for clarity.

Turning now to FIG. 7, once the piston 30 and collar 54 are in abutted contact, the second anchor extension 36 then extends from the housing 14. When this occurs, the first and second pulleys 48, 50 move with the second anchor extension 36 such that the second cable 102 and first and second pulleys 48, 50 change their configuration from that illustrated in FIG. 6 to the configuration illustrated in FIG. 7. The second pulley 50 is in proximity with the third pulley 52 when the second anchor extension 36 is fully extended from the housing 14, while the second pulley 50 remains fixed within the housing 14.

During retraction, the first cable 100 is taken up on spool 72 as the spool 72 rotates along the first direction 104 so that the first anchor extension 24 is retracted into the fully extended second anchor extension 36. The first anchor extension 24 continues to retract within the second anchor extension 36 until the first anchor extension 24 makes contact with a retraction catch in the form of cross pin 90 contained within the opening 37 of the second anchor extension 36 proximate to the second end 40 thereof. (see FIG. 2). While the first anchor extension 24 retracts into the second anchor extension 36, the first and second pulleys 48, 50 of the plurality of pulleys remain in the illustrated configuration of FIG. 8. Friction between the second stops 44 and the housing 14 maintains the position of the second anchor extension 36 relative to the housing 14 (see FIG. 2).

Once the first anchor extension 24 is fully retracted within the second anchor extension 36, the second anchor extension 36 begins its retraction into the housing 14. When this occurs, the second anchor extension 36 moves along a linear direction 64 until the second anchor extension 36 comes in proximity to a mounting plate 91 (see FIG. 2) extending across an end of the housing 14. When this occurs, the pulleys 48, 50 return to the illustrated configuration of FIG. 6, and the second anchor extension 36 is fully retracted within the housing 14.

As will be discussed in greater detail below, the control interface 18 of the shallow water anchor 12 is operably connected to a sensor 92 (see FIG. 2) mounted on the mounting plate 91 that detects when the shallow water anchor 12 is at a fully retracted position. Additionally, it will be recognized that if the Hall sensor 92 fails, the mounting plate 91 functions as a positive stop to prevent further translation of the second anchor extension 36 relative to the housing 14.

Figure 8:
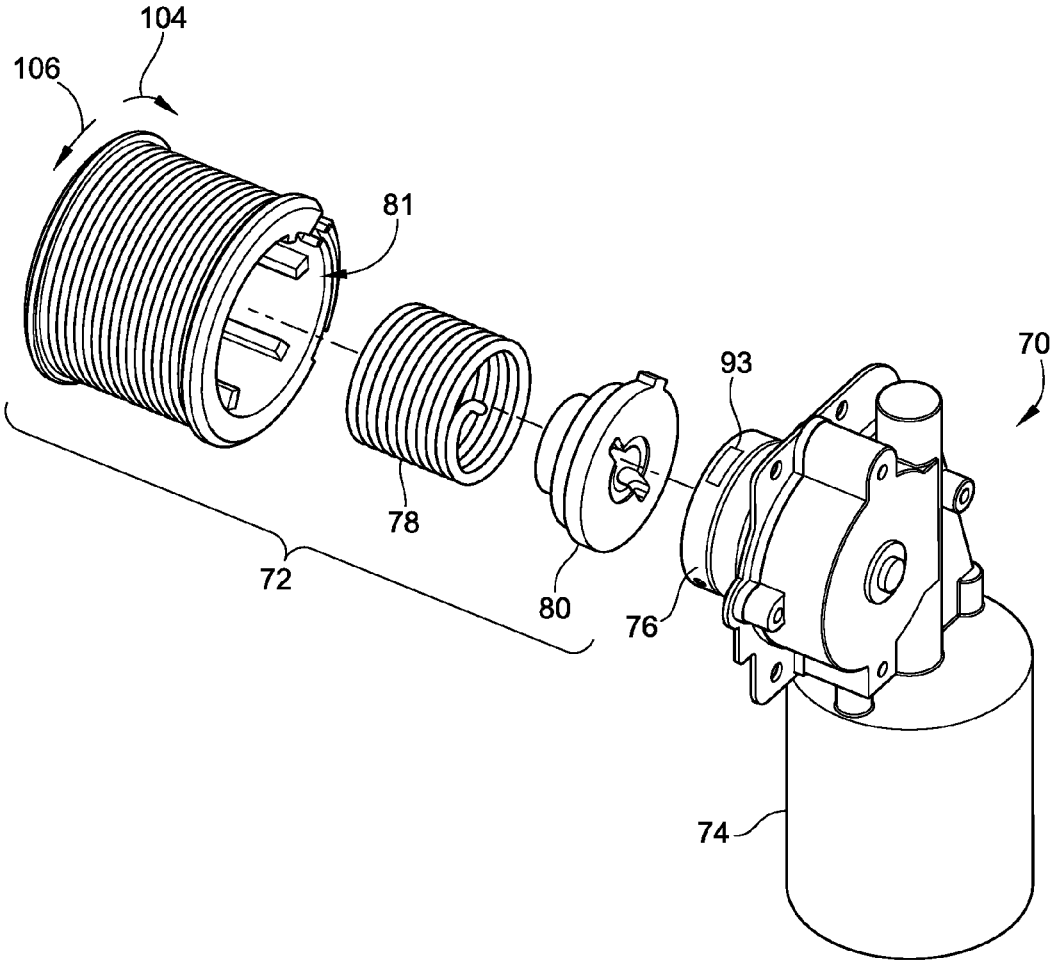
FIG. 8 is an exploded perspective view of a drive assembly of the shallow water anchor of FIG. 1.

With reference now to FIG. 8, one embodiment of the drive assembly 70 includes a motor 74, a spool 72, and a slip clutch 76. The slip clutch 76 operably connects the motor 74 to the spool 72. The spool 72 rotates along the first and second directions 104, 106. The slip clutch 76 is operable to selectively engage and disengage the motor 74 from the spool 72.

The slip clutch 76 disengages the motor 74 from the spool 72 thereby allowing the spool 72 to rotate independently of the motor 74 when an overload condition is present upon the first and second anchor extensions 24, 36. When the boat 10 (see FIG. 1) is loaded with too much gear or personnel or when the shallow water anchor 12 is subjected to excessively turbulent waters, the slip clutch disengages the spool 72 from the motor 74 such that the first anchor extension 24 can freely retract into the second anchor extension 36 to avoid damage to the cables 100, 102 or first anchor extension 24 when the shallow water anchor 12 is in an overloaded state.

In one embodiment, the shallow water anchor 12 includes a biasing compensator including a biasing element 78 to operably connected to at least one of the first anchor extension 24, second anchor extension 36, and actuation arrangement 68. The first anchor extension 24, second anchor extension 36, and actuation arrangement 68 each have a first orientation when the shallow water anchor 12 is in the deployed position, the deployed position not necessarily being equivalent to a fully deployed position. As will be discussed in greater detail below, the biasing compensator is operable to return the first anchor extension to the first orientation upon a displacement to a second orientation.

In an embodiment wherein the biasing compensator is operably connected to the actuation arrangement, the spool 72 includes an end cap 80 and a hollow portion 81. A torsion spring 78 is contained within the hollow portion 81. Hollow portion 81 is enclosed using the cap 80. When the shallow water anchor 12 is in an extended position, it is not uncommon for a boat 10 incorporating the shallow water anchor 12 to encounter turbulent waters. The spool 72 is designed such that the spool can rotate about the end cap 80 from a first orientation to a second orientation while the end cap 80 remains fixed relative to the remainder of the drive assembly 70 (e.g. the slip clutch 76 and the motor 74).

The spool 72 can rotate independently of the end cap 80 of the spool 72 such that the first anchor extension 24 can retract into the second anchor extension 36 without any rotation of the motor 74 of the drive assembly 70. This rotation loads energy onto the torsion spring 78. The torsion spring 78 is then operable to place the spool 72 back into its default angular orientation when the shallow water anchor 12 is in the extended position commensurate with a deployed position of the first anchor extension, upon an angular displacement of the spool. It will be recognized that even where the spool rotates a full 360 degrees, the torsion spring will in turn counter rotate the spool back to its original angular position prior to rotation. As a result, when supplied with the torsion spring 78 and end cap 80, the drive assembly 70 allows for a partial linear retraction and return extension of the shallow water anchor 12, and more particularly the partial linear retraction of the first anchor extension 24 into the second anchor extension 36 to compensate for waves or other turbulent waters. In other embodiments, the biasing compensator can take the form of other types of resilient biasing members, and is not necessarily limited to mechanical springs as discussed above.

Figure 9:
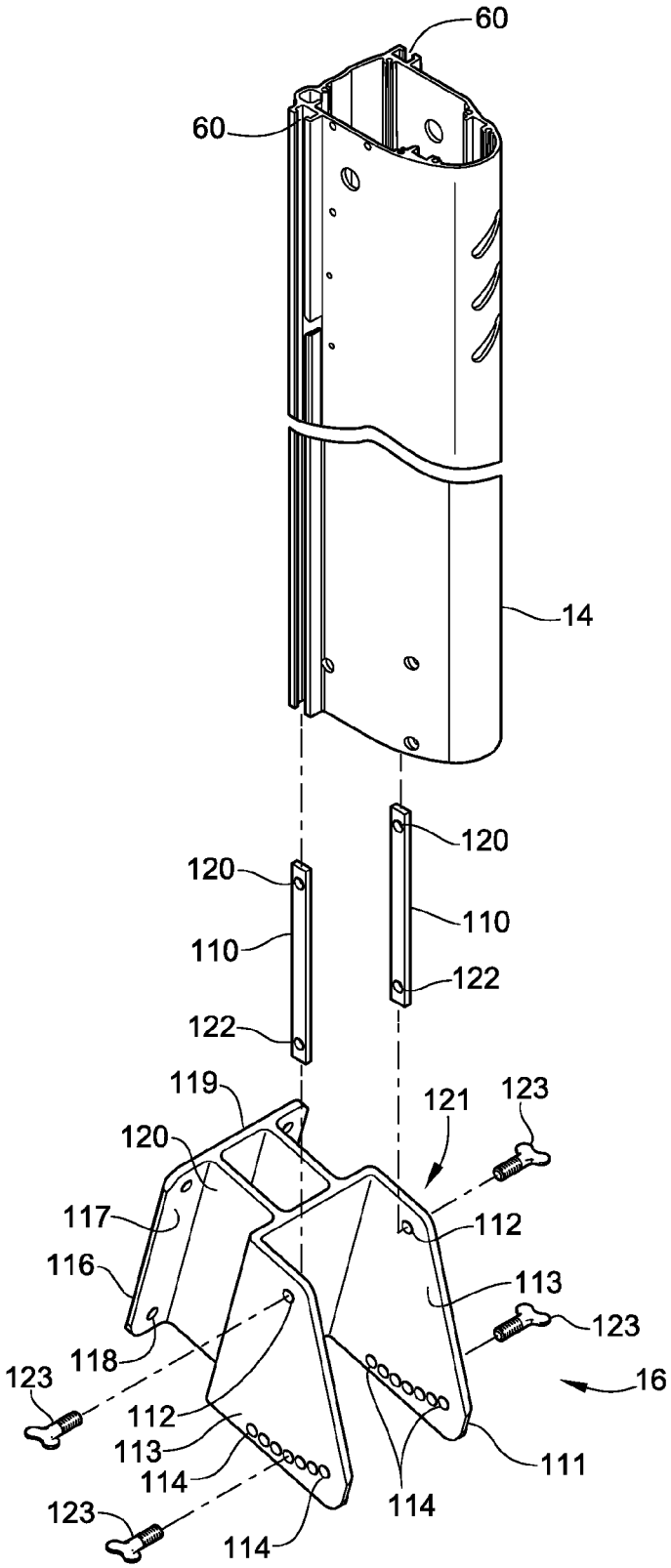
FIG. 9 is an exploded perspective view of a mounting bracket of the shallow water anchor of FIG. 1.

With reference now to FIG. 9, the shallow water anchor 12 mounts to the transom 13 of a boat 10 (see FIG. 1) using a mounting bracket 16. As will be discussed in greater detail below, the mounting bracket 16 mounts with the housing 14 via a connection arrangement interposed between the mounting bracket 16 and the housing 14. In one embodiment, the connection arrangement includes at least one mounting bar 110 that is slidably received by at least one channel 60 formed on the exterior of the housing 14. In the illustrated embodiment of FIG. 9, a pair of longitudinally extending channels 60 in opposed spaced relation on the housing 14 receive the pair of mounting bars 110, respectively. The channels 60 are generally parallel to the longitudinal axis of the shallow water anchor 12. The channels 60 are dimensioned to slidably receive the mounting bars 110. The mounting bars 110 are slidable within the channels 60 to selectively position the housing 14 relative to the mounting brackets 16.

The mounting bracket 16 includes a baseplate 116 extending between a front surface 117 and a rear surface 119. A neck support 120 extends transversely away from the front surface 117 of the mounting plate 116 and supports a U-shaped bracket 111. The U-shaped bracket 111 includes a channel 121 to receive the housing 14.

The baseplate 116 has a generally rectangular profile. The back surface 119 of the baseplate 116 is in surface contact with the transom 13 of a boat 10 when the shallow water anchor 12 is in a fully mounted position. The mounting plate 116 mounts with the transom 13 via mounting holes 118.

The neck support 120 extends transversely away from the front surface 117 of the baseplate 116. The neck support supports a U-shaped bracket 111. The U-shaped bracket 111 includes a pair of sidewalls 113 in opposed spaced relation. The sidewalls 113 define the channel 121. Each of the pair of sidewalls 113 includes a base mounting hole 112 and an arcuate array of mounting holes 114. As will be discussed in greater detail below, the base mounting hole 112 and one of the arcuate array of mounting holes 114 each correspond to a first and second mounting hole 120, 122 of each mounting bar 110. As a result, the first and second mounting holes 120, 122 of each mounting bar 110 define first and second mounting points of the housing 14 relative to the mounting bracket 16.

The first hole 120 of each mounting bar corresponds to the base mounting hole 112 of each sidewall 113. The second hole 122 of each mounting bar 110 corresponds to one of each of the arcuate array of mounting holes 114 of each of the sidewalls 113. As a result, the shallow water anchor 12 is angularly positionable relative to the mounting bracket 16 by aligning the first hole 120 with the mounting hole 112, and the second hole 122 with one of the arcuate array of holes 114. Once these holes 112, 114, 120, 122 are aligned, a pin, bolt, or other like fastener 123 can be installed therethrough to affix the mounting bars 110 to the mounting bracket 16.

When the fasteners 123 are installed, the mounting bar 110 is pulled towards a pair of retention flanges 125 (see FIG. 3) in each channel 60 of the housing 14. As a result, the mounting bars 110 make a frictional contact with the channels 60 of the housing 14 to fixedly retain the housing 14 relative to the mounting bracket.

Figure 11:
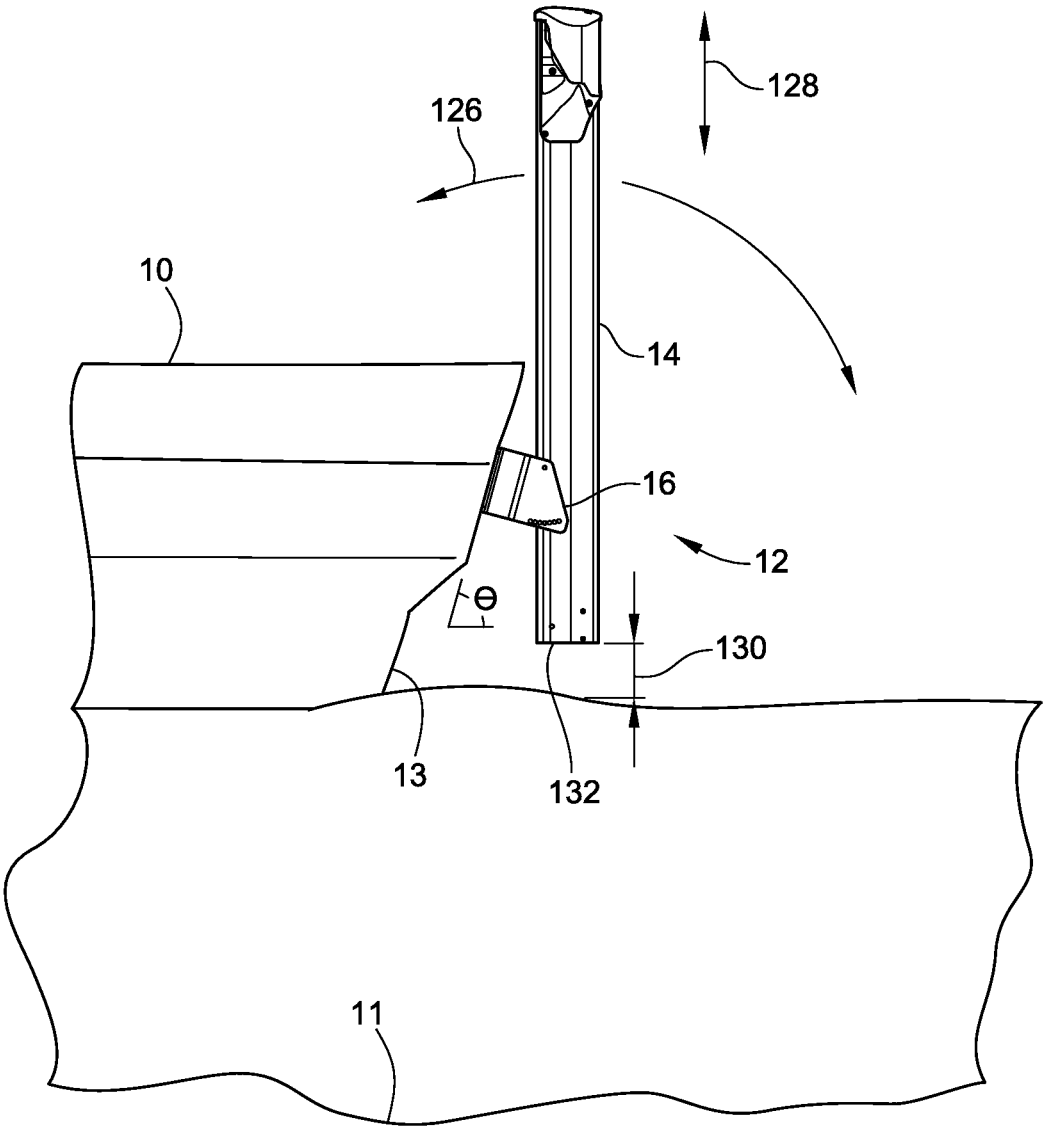
FIG. 11 side view of the shallow water anchor of FIG. 1.

With reference to FIG. 11, as a result of the relationship between the mounting bars 110 and the channels 60 (see FIG. 9), the shallow water anchor 12 is angularly adjustable along an angular direction 126 relative to the transom 13 of the boat 10. The shallow water anchor 12 is also linearly adjustably relative to the mounting bracket 16 along a linear direction 128. This functionality of the mounting bracket 16 allows a user to position the shallow water anchor 12 such that it is generally normal to the surface of the water, and at a desirable height 130 above the water.

Figure 12A:
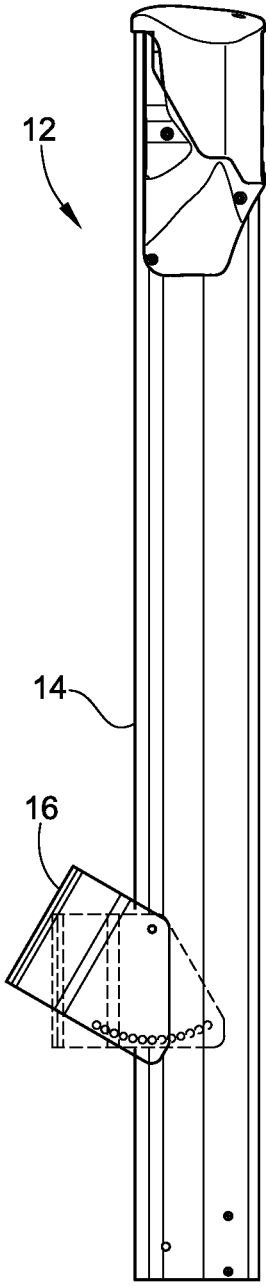
FIG. 12A-12B are side views of separate configurations of a mounting bracket of the shallow water anchor of FIG. 1.
Figure 12B:
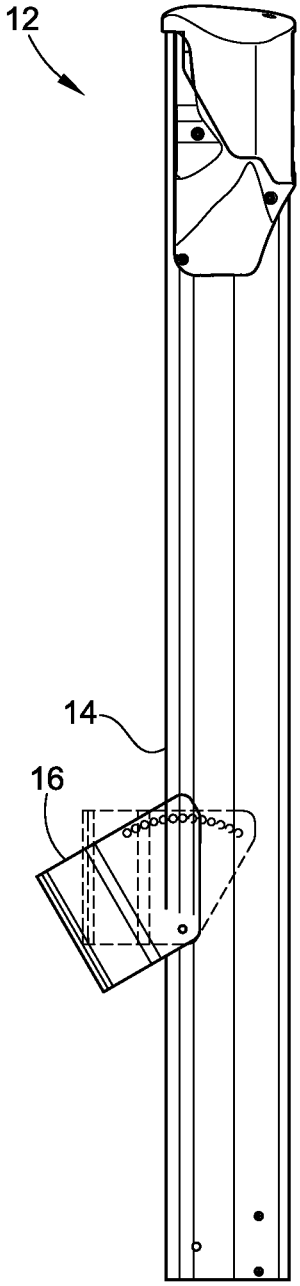

Turning now to FIG. 12A, as discussed above, the mounting bracket 16 has a number of angular positions relative to the housing 14. Additionally, the mounting bracket 16 can be turned upside down and installed relative to the housing 14. Those skilled in the are will recognize from FIG. 12B that the reversible functionality of the mounting bracket 16 allows for use of the shallow water anchor 12 to maintain perpendicularity to the water in boats with positive and negative transom angles θ (see FIG. 11).

Figure 10:
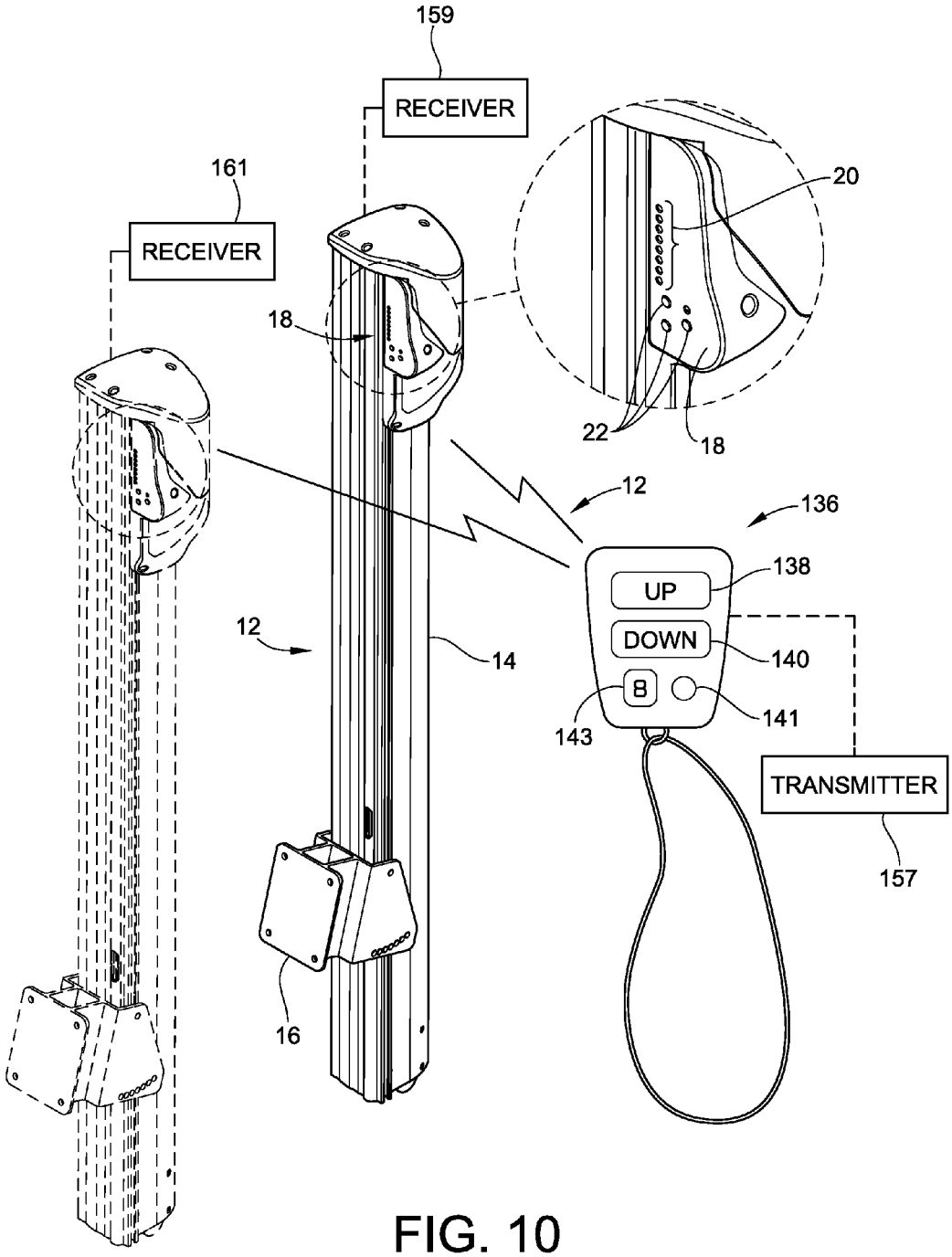
FIG. 10 is a perspective view of a shallow water anchor of FIG. 1.

Turning back to FIG. 10, a user can control the shallow water anchor 12 via a plurality of control buttons or switches 22 extending from the housing 14. The control buttons 22 are in electronic communication with a controller of the control interface 18. In one embodiment, the plurality of control buttons 22 includes an up button and a down button. To extend the shallow water anchor 12 to an extended position, a user presses the down button. Similarly, to retract the shallow water anchor 12 to the fully retracted position, the user depresses the up button.

In one embodiment, the shallow water anchor 12 will extend to the fully extended position upon a single depression of the down button, and retract to the fully retracted position upon a single depression of the up button. In such an embodiment, the control interface 18 detects when the first anchor extension 24 has extended to a position sufficient to anchor the watercraft. Also in such an embodiment, the control interface 18 detects when the first anchor extension 24 and/or the second anchor extension 36 is in the fully retracted position within the housing 14. Accordingly, in this embodiment, a user is not required to press and hold either of the up or down buttons but can effectuate a full extended position and a full retracted position by simply pressing the corresponding up or down button of the plurality of control buttons 22 a single time.

In one embodiment, the shallow water anchor 12 is supplied with a remote control 136. The remote 136 incorporates an up and a down button 138, 140. In this embodiment, a user can extend the shallow water anchor 12 to the fully extended position by depressing the down button 140 twice in rapid succession. Similarly, the user can fully retract the shallow water anchor 12 to the fully retracted position by depressing the up button 138 twice in rapid succession. In other embodiments, the up and down buttons 138, 140 need only be pressed a single time.

In one embodiment, the control interface 18 is configured to save into memory or "learn" the unique signal of a plurality of remotes 136. This allows more than one user, e.g. fisherman, to have control of a single anchor. Additionally, a single remote 136 can learn and control multiple shallow water anchors 12. In this embodiment, the remote 136 will include an anchor selection button 141 and an anchor indicator 143. Once the remote 136 has learned multiple shallow water anchors 12, the user selects an appropriate anchor 12 to control by depressing the anchor selection button 141 until a number assigned to the particular anchor 12 is shown in the anchor indicator 143. The remote 136 can also simultaneously control all the anchors 12 learned by the remote 136.

To facilitate this functionality, the remote 136 includes a transmitter arrangement, i.e. a transmitter 157, and the shallow water anchor 12 includes a receiver. Where a plurality of anchors are used, each shallow water anchor 12 will include a stand alone receiver 159, 161. The remote 136, in part by way of the transmitter 157, is operable to directly control each shallow water anchor 12 independently of each other shallow water anchor 12 to initiate an alteration in the operation thereof.

In one embodiment, the remote 136 controls the shallow water anchors 12 simultaneously. However, as noted above, in other embodiments, the remote 136 directly controls each shallow water anchor 12 independently of each other shallow water anchor 12, in such a way that the transmitter 157 sends distinct signals to each receiver 159, 161 that do not interact or otherwise interfere with one another. For example, the remote 136 can send a signal to a receiver 159 of one shallow water anchor 12 such that the anchor only alters its mode of operation in response to that signal, and not a signal sent to another receiver 161. A user can manipulate the manner in which the remote 136 controls various anchors 12 by using the anchor selector switch 141 such that the remote controls a single anchor 12 or multiple anchors 12 simultaneously.

The control interface 18 includes a visual indicator in the form of a depth indicator 20 to indicate the overall depth of the first and second anchor extensions 24, 36 (see FIG. 2). In the illustrated embodiment, the depth indicator 20 is a linear array of LED lights. Each LED light corresponds to approximately one foot of extension of the first and second anchor extensions 24, 36. It will be recognized that other methods of depth indication can be employed in other embodiments. For example, the depth indicator 20 can take the form of a numeric display or a mechanical dial instrument.

As discussed above, the control interface 18 of the shallow water anchor 12 couples to a sensor 92 (see FIG. 2) that senses the position of the first anchor extension 24 when the first anchor extension 24 is in a fully retracted position. The control interface 18 thereafter stops the motor 74 of the drive assembly 70 (see FIG. 2) from continuing to supply a torque to the drive assembly 70 after the shallow water anchor 12 has achieved the fully retracted position. An additional sensor 93 (see FIG. 8) can also be provided to count motor revolutions to thereby determine the length of extension indicated by the depth indicator 20.

The control interface 18 is also operable to determine when the shallow water anchor 12, and more particularly the first anchor extension 24 and, where applicable, the second anchor extensions 36 have reached an extended position sufficient to anchor a boat 10 incorporating the shallow water anchor 12.

The control interface 18 is further operable to determine when the first and second anchor extensions 24, 36 are at a maximum extended position. When either of the above conditions defining either an extended anchored position or a maximum extended position are detected by the control interface 18, the control interface 18 stops the motor 74 from continuing to supply a torque to the drive assembly to further extend the shallow water anchor 12. In one embodiment, the control interface 18 determines when the above conditions are met by sensing a current load on the motor 74.

Additionally, the control interface 18 can provide an additional safety feature, whereby the shallow water anchor 12 provides an audible alarm that alerts a user when the shallow water anchor 12 is in an extended position and the ignition of the boat 10 is switched on. As a result, a user is audibly warned that the shallow water anchor 12 is still deployed upon starting the outboard motor of the boat 10. The control interface 18 accomplishes this task by connecting directly to the 12v power supply of the ignition system of the boat 10.

Having discussed the structural attributes of various embodiments, the discussion will now turn to the operation of embodiments of the shallow water anchor 12.

Figure 13:
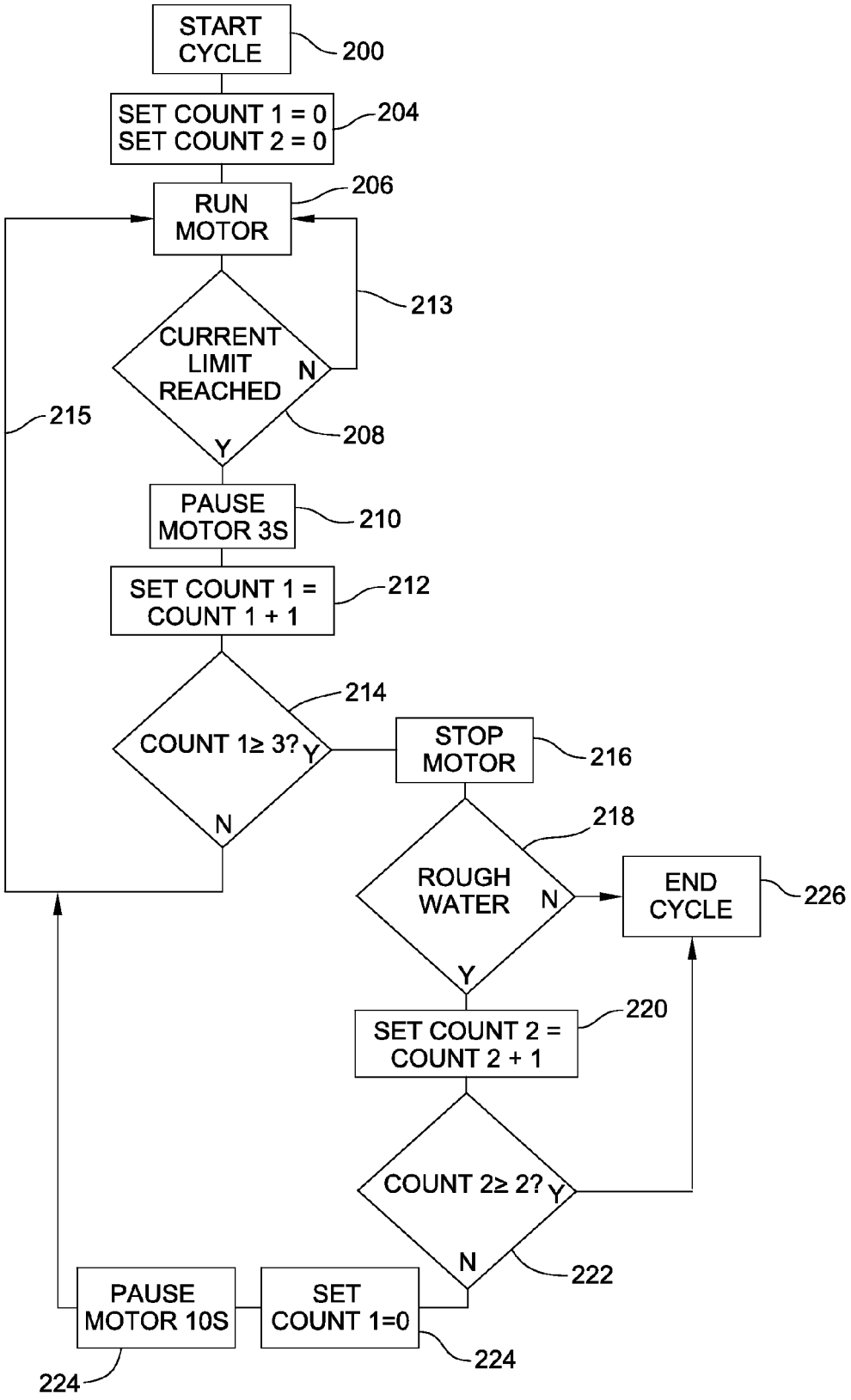
FIG. 13 is flow chart depicting the schematic operation of the shallow water anchor of FIG. 1.

FIG. 13 is a schematic representation of one embodiment of control logic employed by the control interface 18 to determine whether the shallow water anchor 12 has reached an extended position sufficient to anchor a boat 10 incorporating the shallow water anchor 12, or to determine when the shallow water anchor 12 has reached the fully extended position. When a user depresses the down button of the plurality of control buttons 22 on the shallow water anchor 12 or the down button 140 of the remote 136, the control interface 18 starts the extension cycle indicated schematically as step 200.

Once the cycle begins, a pair of variables schematically illustrated as "Count 1" and "Count 2" are zeroed in step 204. The motor 74 of the drive assembly 70 then begins to rotate the spool 72 in the second direction 106 such that the second cable 102 is wound about the spool 72 and the first cable 100 is unwound from the spool 72 as the first anchor extension extends in a linear direction 64 out of the housing 14 at step 206 of FIG. 13. (see FIGS. 6-8). The motor 74 will continue to run in step 206 of FIG. 13 until a predefined current limit is detected by a sensor coupled to the control interface 18 in step 208. The predefined current limit is reached in step 208 when either the first anchor extension 24 has come into interference with the bottom 11 of the body of water (see FIG. 1), or when both the first and second anchor extensions 24, 36 have reached a fully extended state as illustrated in FIG. 7. In one embodiment, the current limit at step 208 is approximately 30 amps through the motor as detected by the control interface 18.

Once the current limit at step 208 has been reached, the control interface 18 will pause the motor for a predetermined period of time at step 210. In the schematic illustration of FIG. 13, the predetermined period of time is three seconds. Once this pause is complete, the variable Count 1 is incrementally increased by one at step 212 and the control interface 18 in turn verifies if the count is greater than 3 at step 214. If Count 1 is greater than 3, as determined at step 214, the control interface 18 stops the motor at step 216. If the control interface 18 determines at step 214 that Count 1 is less than 3, than the control interface 18 repeats steps 206 through 212 until Count 1 is greater than 3 at step 214. Accordingly, once the current limit is first reached at step 208, the control interface 18 will attempt to continue to extend the first and second anchor extensions 24, 36 an additional two times as schematically represented by loop 215. This functionality is particularly useful to ensure that the first anchor extension 24 has fully seated within the bottom 11 of a body of water.

More particularly, it is possible for the control interface 18 to detect that the current limit has been reached when the first anchor extension has not fully engaged the bottom surface 11 of the body of water due. For example, excessive undulations in the water can cause the vertical distance between the boat 10 and the bottom surface 11 to fluctuate, thereby causing the length of extension required to anchor the boat 10 to likewise fluctuate. As a result, and in one embodiment, the shallow water anchor 12 makes three successive attempts, i.e. "auto-packs", during loop 215. Loop 15 generally represents a pack cycle. Incorporation of the pack cycle ensures the first anchor extension 24 is fully seated in the bottom surface 11 of the body of water. In other embodiments, this "auto-pack" feature can include more or less successive attempts to extend the first anchor extension 24.

The control interface 18 can also incorporate control logic to effectuate a rough water mode. The rough water mode can be selected using a rough water switch of the plurality of control buttons 22 (see FIG. 10). In one embodiment, the rough water mode repeats loop 215 an additional two times to further ensure that the first anchor extension 24 has reached a length of extension to anchor the boat 10.

The rough water mode is schematically illustrated at steps 218 through 225. If the rough water mode is set to on as determined at step 218, the variable Count 2 is incrementally increased by one at step 220. The control interface 18 then verifies if Count 2 is greater than 2 at step 222. If Count 2 is not greater than 2, than the control interface 18 resets Count 1 equal to zero at step 223 and thereafter pauses the motor for a predetermined time at step 224. In the illustrated embodiment of FIG. 13, the predetermined period of time at step 224 is ten seconds. The control interface 18 thereafter reinitiates loop 215 as discussed above until Count 1 is again greater than 3 at step 214. The control interface 18 then repeats the rough water mode a final time such that loop 215 is once again repeated and Count 2 is thereafter greater than 2 at step 222. Once Count 2 is greater than 2, the extension cycle ends at step 226. In the event that the rough water mode is set to off, the extension cycle ends at step 226 after step 216 once loop 215 has completed its successive iterations as discussed above.

The schematic representation of the control logic of the control interface 18 as illustrated in FIG. 13 is not limiting upon the operation of the control interface 18. In other embodiments, the control interface 18 can employ other forms of control logic to effectuate the functionality as discussed above. Indeed, the control interface 18 can employ alternative control logic to effectuate the sequential extension of the first anchor extension 24 from the second anchor extension 36 until the shallow water anchor 12 has reached a sufficient length of extension to anchor a boat 10 incorporating the shallow water anchor 12, or until the first anchor extension has first fully extended from the second anchor extension 36 and the second anchor extension has thereafter fully extended from the housing 14.

Figure 14:
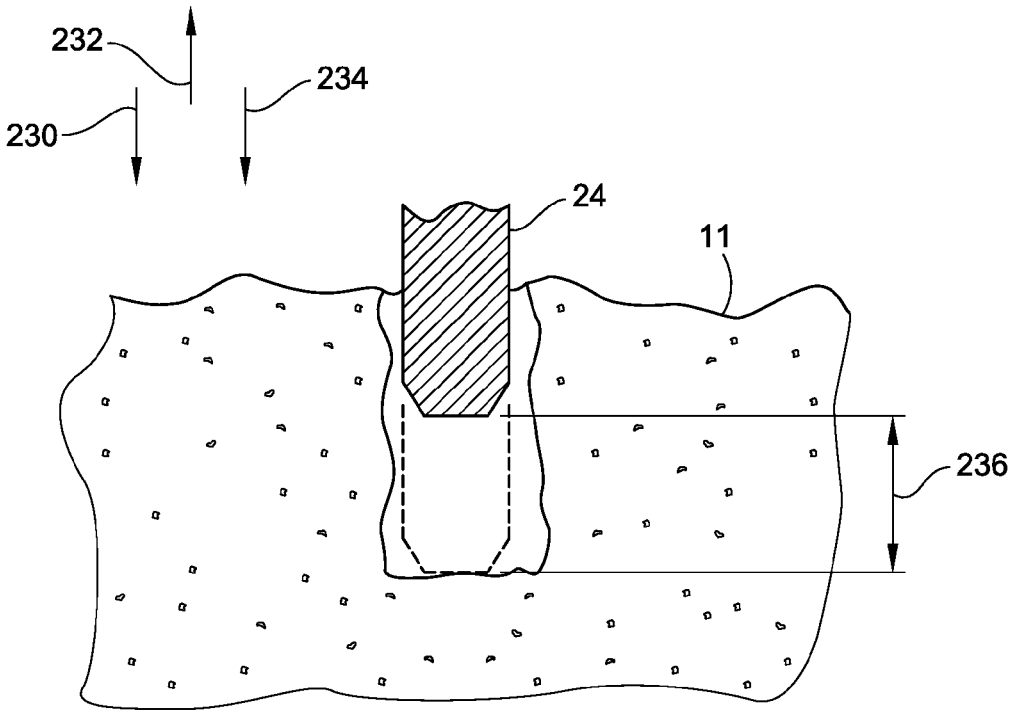
FIG. 14 is a partial cross sectional view of the shallow water anchor of FIG. 1 during a stage of operation of an alternative embodiment of operation.

With reference now to FIG. 14, an alternative embodiment of operation of the shallow water anchor 12 is illustrated. In this embodiment, during a pack cycle 215, the first anchor extension 24 extends in a first direction 230 until a first condition is met, e.g. a current limit, at step 208. The first anchor extension then retracts in a second direction 232 until a second condition is met, e.g. the passage of 3 seconds at step 210. When this occurs, the first anchor extension retracts a distance 236 that is a function of the second condition. The first anchor extension 24 then deploys again along direction 234 until a third condition is met, e.g. the current limit being again reached at step 208.

Figure 15:
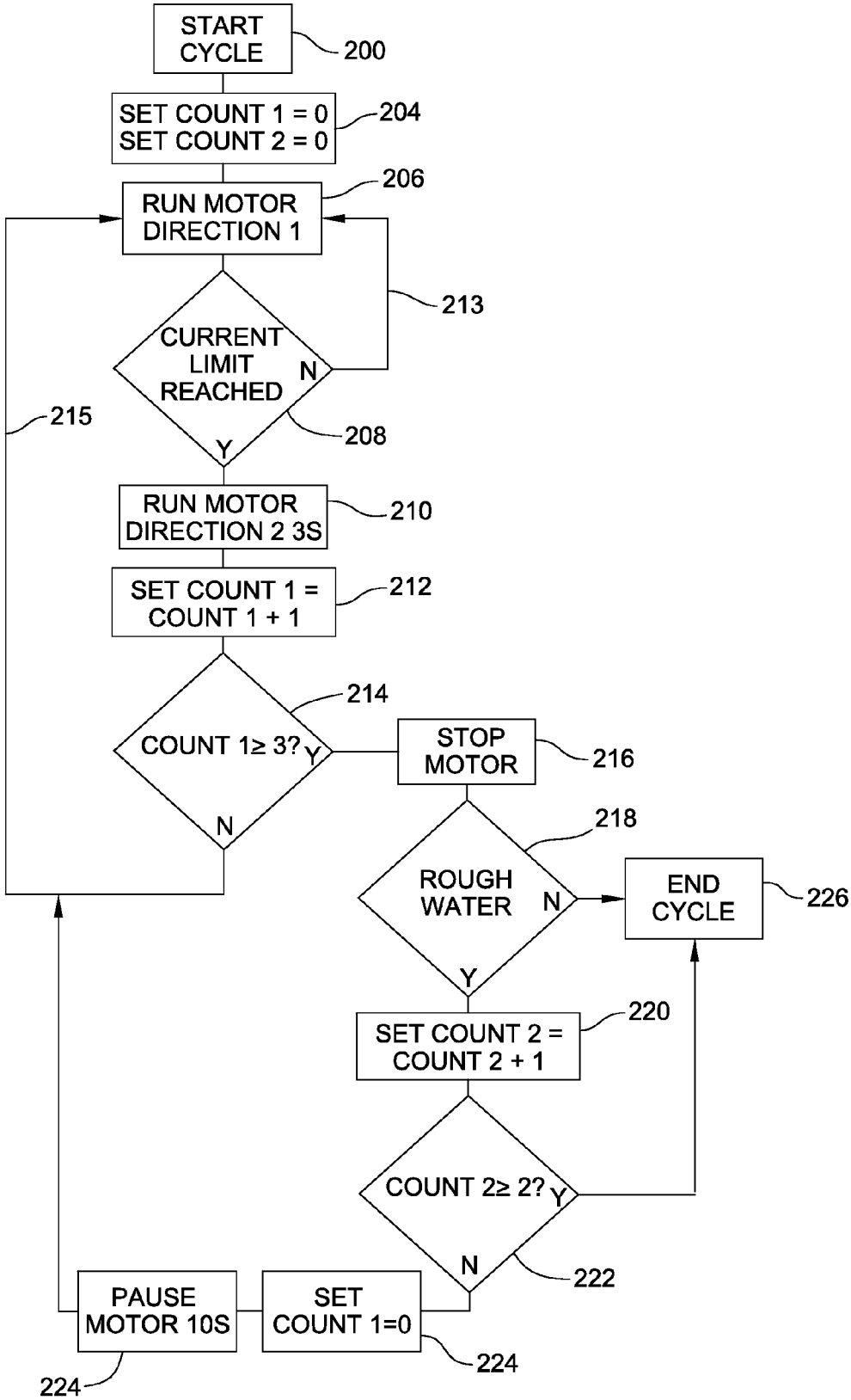
FIG. 15 is a flow chart depicting the alternative embodiment of the schematic operation of the shallow water anchor of FIG. 1.

An embodiment of the control logic used to implement the operation in FIG. 14 is illustrated in FIG. 15. In this embodiment, the motor 74 supplies a torque in a first direction at step 206. At step 210, the motor 74 supplies a torque in a second direction at step 210 for 3 seconds, instead of pausing for 3 seconds. As a result, the first anchor extension 24 "backs off" or partially retracts during successive iterations of the pack cycle represented in loop 215.

It will be recognized that in both the embodiments schematically represented in FIGS. 12 and 14, a parameter other than current limit can be used as a condition at step 208. Similarly, a parameter other than time can be used as a condition at steps 210 and 224 in either embodiment of FIGS. 13 and 15.

As described herein, the shallow water anchor 12 allows a commercial or recreational user to precisely locate a boat 10 incorporating the shallow water anchor 12 in a desired area. The shallow water anchor 12 produces a minimal amount of noise and splash as it anchors the boat 10 so as not to obscure the shallow water or to scare away any fish. Embodiments of the shallow water anchor 12 achieve these advantages by sequentially extending in a linear direction a first anchor extension 24 from a second anchor extension 36 and thereafter extending the second anchor extension 36 from a housing 14 containing both the first and second anchor extensions 24, 36 when the shallow water anchor is in a retracted position.

The shallow water anchor 12 utilizes a control interface 18 that determines when an actuation arrangement 68 has placed the shallow water anchor 12 in an extended position sufficient to anchor the boat 10. The actuation arrangement 68 is operable to smoothly and quietly linearly extend the first and second anchor extensions 24, 36 with enough force to fully penetrate the bottom surface 11 of a body of water so as to anchor the boat 10. By utilizing only a linear extension, the shallow water anchor 12 does not require a more complex linkage such as a four bar mechanism or the like. By way of sequential extension, the shallow water anchor 12 also preserves the life span of operability of the first and second anchor extensions 24, 36 by reducing the amount of exposure to the second anchor extension 36 to situations where the effective length of the first anchor extension 24 alone is not sufficient to anchor the boat 10.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. An anchor for a watercraft, comprising:

a first anchor extension;

a second anchor extension attached to the first anchor extension;

a base member attached to the second anchor extension;

an actuation arrangement operable to sequentially axially drive the first and second anchor extensions in a deployment direction, the second anchor extension remaining in a substantially constant position relative to the base member until the first anchor extension has transitioned to a fully deployed position relative to the second anchor extension in the deployment direction;

wherein the first anchor extension includes an anchoring portion and a stopping portion, and the second anchor extension includes a deployment catch portion, the stopping portion of the first anchor extension axially abutting the deployment catch portion of the second anchor extension in the fully deployed position, thereafter, the first and second anchor extensions deploying relative to the base member in unison; and wherein the stopping portion is formed by a piston at an end of the anchoring portion, wherein the actuation arrangement is mechanically directly connected to the piston to move the first anchor extension wherein the deployment catch portion is carried by the second anchor extension, the anchoring portion extending through the deployment catch portion in the fully deployed position, the piston axially abutting the deployment catch portion in the fully deployed position.

2. The anchor of claim 1, further comprising:

a first cable operably connected to the first anchor extension;

a second cable operably connected to the first anchor extension;

a spool, the first and second cables being windable and un-windable thereabout; and a motor operably connected to the spool to wind and unwind the first and second cables about the spool to selectively deploy and retract the first and second anchor extensions from the base member.

3. The anchor of claim 2 wherein the motor operably rotates the spool in a first direction to simultaneously wind the first cable and unwind the second cable about the spool, and wherein the motor operably rotates the spool in a second direction to simultaneously wind the second cable and unwind the first cable about the spool, wherein rotation in the first direction deploys the first anchor extension relative to the second anchor extension, and wherein rotation in the second direction retracts the first anchor extension relative to the second anchor extension.

4. The anchor of claim 2 further comprising a first, a second, and a third pulley, the first and second pulleys affixed to the second anchor extension, and the third pulley affixed to the base member, the first and second pulleys movable relative to the base member with the second anchor extension.

5. The anchor of claim of claim 2 further comprising a slip clutch disposed between the motor and the spool, the slip clutch operable to transfer a torque from the motor to the spool, wherein the slip clutch disengages the spool from the motor to allow the spool to rotate independently of and relative to the motor when a predetermined load threshold of the anchor is reached.

6. The anchor of claim 2 further comprising a biasing element carried within the spool, the biasing element operable to bias the spool back to a default angular orientation upon an angular displacement of the spool away from the default angular orientation.

7. The anchor of claim 6 wherein the default angular orientation is commensurate with a fully deployed position of the anchor, and wherein the angular displacement is commensurate with an axial displacement of the first anchor extension into the second anchor extension.

8. The anchor of claim 1, further comprising:

an actuation arrangement operable to deploy and retract the first anchor extension relative to the second anchor extension and deploy and retract the second anchor extension relative to the base member; and a biasing compensator operably connected to at least one of the first anchor extension, second anchor extension, and actuation arrangement, the biasing compensator returning the at least one of the first anchor extension, second anchor extension, and actuation arrangement to a first orientation after displacement therefrom to a second orientation.

9. The anchor of claim 8 wherein the biasing compensator is a torsion spring, and wherein the actuation arrangement includes a spool operably coupled to the first anchor extension to deploy and retract the first anchor extension upon coordinated rotation thereof, the torsion spring torsionally connected to the spool to oppose retraction of the first anchor extension when an external load is applied to the anchor causing the first anchor extension to retract, the first orientation defining an angular position of the spool when the anchor is in a deployed position, and a second angular position being a different angular position relating to a retracted position relative to the deployed position.

10. The anchor of claim 8 wherein the first anchor extension is operably connected to the actuation arrangement such that the displacement is a partial linear retraction of the first anchor extension axially relative to the second anchor extension.

11. The anchor of claim 10 wherein the partial linear retraction has a maximum distance of about 5 inches to about 10 inches.

12. An anchor for a watercraft, comprising:

a first anchor extension;

a second anchor extension attached to the first anchor extension;

a base member attached to the second anchor extension;

an actuation arrangement operable to sequentially axially drive the first and second anchor extensions in a deployment direction, the second anchor extension remaining in a substantially constant position relative to the base member until the first anchor extension has transitioned to a fully deployed position relative to the second anchor extension in the deployment direction;

further comprising at least one guide arrangement interposed between the second anchor extension and the base member, the at least one guide arrangement operable to linearly guide the second anchor extension in the deployment direction relative to the base member; and wherein the at least one guide arrangement includes an inner slide channel associated with the second anchor extension and aligned with an outer slide channel associated with the base member, the at least one guide arrangement further comprising a first stop affixed to the base member and slidable within the inner slide channel, and a second stop affixed to the second anchor extension and slidable within the outer slide channel, the first and second stops in abutted contact when the second anchor extension is fully deployed along the deployment direction relative to the base member.

13. The anchor of claim 12 wherein at least one of the first stop and second stop is biased away from the base member or the second anchor extension, respectively, and into frictional contact with the other one of the second anchor extension or the base member, respectively, the frictional contact being sufficient to prevent translation of the second anchor extension relative to the base member as the first anchor extension is deployed relative to the second anchor extension.

14. The anchor of claim 13 wherein the frictional contact is sufficient to prevent the second anchor extension from translating relative to the base member as the first anchor extension is retracted relative to the second anchor extension in a retraction direction being opposite the deployment direction, at least until the first anchor extension is in the fully retracted position relative to the second anchor extension.

15. An anchor for a watercraft, comprising:

a first anchor extension;

a second anchor extension attached to the first anchor extension;

a base member attached to the second anchor extension;

an actuation arrangement operable to sequentially axially drive the first and second anchor extensions in a deployment direction, the second anchor extension remaining in a substantially constant position relative to the base member until the first anchor extension has transitioned to a fully deployed position relative to the second anchor extension in the deployment direction;

wherein the first anchor extension includes an anchoring portion and a stopping portion, and the second anchor extension includes a deployment catch portion, the stopping portion of the first anchor extension axially abutting the deployment catch portion of the second anchor extension in the fully deployed position, thereafter, the first and second anchor extensions deploying relative to the base member in unison; and further comprising a retraction catch affixed to the second anchor extension, wherein the first anchor extension has a fully retracted position relative to the second anchor extension, and wherein the stopping portion is in axially abutted contact with the retraction catch in the fully refracted position, the stopping portion being axially interposed between the retraction catch and the deployment catch.

16. An anchor for a watercraft, comprising:

a first anchor extension;

a second anchor extension;

a base member carrying the first and second anchor extensions;

a first cable operably connected to the first anchor extension;

a second cable operably connected to the first anchor extension;

a spool, the first and second cables being windable and un-windable thereabout;

a motor operably connected to the spool to wind and unwind the first and second cables about the spool to selectively deploy and retract the first and second anchor extensions from the base member;

further comprising a control interface that controls the motor to axially deploy the first and second anchor extensions relative to the base member, wherein the control interface detects when the anchor has reached a deployed position sufficient to anchor a watercraft in an anchored position, and stops the motor once the anchor reaches the deployed position;

wherein the control interface controls the motor to retract the first and second anchor extensions relative to the base member, wherein the control interface detects when the anchor has reached a fully retracted position and stops the motor once the anchor reaches the retracted position; and wherein the control interface includes a visual indicator indicating a length of anchor deployed.

* * * * *